US009738112B2

(12) United States Patent
Kageyama et al.

(10) Patent No.: US 9,738,112 B2
(45) Date of Patent: Aug. 22, 2017

(54) MECHANICAL PENCIL

(71) Applicant: KOTOBUKI & CO., LTD, Saitama (JP)

(72) Inventors: Hidehei Kageyama, Saitama (JP); Tadao Odaka, Saitama (JP)

(73) Assignee: KOTOBUKI & CO., LTD., Saitama (JP)

( * ) Notice: Subject to any disclaimer, the term of this patent is extended or adjusted under 35 U.S.C. 154(b) by 204 days.

(21) Appl. No.: 14/780,226

(22) PCT Filed: Mar. 26, 2014

(86) PCT No.: PCT/JP2014/059693

§ 371 (c)(1),
(2) Date: Sep. 25, 2015

(87) PCT Pub. No.: WO2014/157731

PCT Pub. Date: Oct. 2, 2014

(65) Prior Publication Data

US 2016/0039244 A1 Feb. 11, 2016

(30) Foreign Application Priority Data

Mar. 26, 2013 (JP) ..... 2013-063427

(51) Int. Cl.
*B43K 21/22* (2006.01)
*B43K 21/18* (2006.01)
*B43K 21/02* (2006.01)

(52) U.S. Cl.
CPC ..... *B43K 21/22* (2013.01); *B43K 21/02* (2013.01); *B43K 21/18* (2013.01)

(58) Field of Classification Search
CPC ..... B43K 21/22; B43K 21/02; B43K 21/027; B43K 21/06; B43K 21/08; B43K 21/085; B43K 21/10; B43K 21/16; B43K 21/18
See application file for complete search history.

(56) References Cited

U.S. PATENT DOCUMENTS 6,517,272 B1 * 2/2003 Kageyama ..... B43K 29/02 401/67
6,783,292 B2 * 8/2004 Arai ..... B43K 21/22 401/65

(Continued)

FOREIGN PATENT DOCUMENTS

JP 10329485 A 12/1995
JP 4240417 B2 3/2009

(Continued)

OTHER PUBLICATIONS

International Search Report from the Japanese Patent Office, International Application No. PCT/JP2014/05969 dated Jun. 25, 2014.

*Primary Examiner* — David Walczak
(74) *Attorney, Agent, or Firm* — The Marbury Law Group, PLLC

(57) ABSTRACT

A mechanical pencil is including a tubular shaft, a chuck unit movably arranged in the shaft, a front rotary element adapted to be moved rearward as the unit is moved rearward, a rear rotary element adapted to be moved rearward as the front rotary element is moved rearward, a conversion means for causing the rear rotary element to rotate in a normal rotational direction as the rear rotary element is moved rearward and allowing the rear rotary element to rotate in a reverse rotational direction as the rear rotary element is moved forward, a normal directional rotation transmitting means for allowing the front rotary element to be rotated in the normal rotational direction and the rear rotary element to be idly rotated, and a reverse directional rotation restricting mechanism allowing the normal directional rotation of the front rotary element but preventing the reverse directional rotation of the front rotary element.

8 Claims, 14 Drawing Sheets

(56) References Cited

U.S. PATENT DOCUMENTS 7,802,936 B1 * 9/2010 Izawa ..... B43K 21/003
401/194
8,920,057 B2 * 12/2014 Noguchi ..... B43K 21/02
401/65

FOREIGN PATENT DOCUMENTS

JP 2010120204 A 6/2010
JP 2011173343 A 9/2011

* cited by examiner

MECHANICAL PENCIL

This application is a national phase entry of International Application Number PCT/JP2014/059693, filed Mar. 26, 2014, and claims priority of Japanese Application Number 2013-063427, filed Mar. 26, 2013.

TECHNICAL FIELD

The present invention relates to a mechanical pencil in which a writing lead is adapted to be rotated using a writing force.

BACKGROUND ART

When writing is performed by a mechanical pencil, the writing is often performed in a state where a tubular shaft of the mechanical pencil is slightly inclined with respect to a surface of a sheet of paper. If the writing is continued in the state where the tubular shaft of the mechanical pencil is inclined in this way, the tip end of a writing lead is unsymmetrically worn, and an area of a contact surface of the tip end of the writing lead which contacts the surface of the sheet of paper, namely, an area of the unsymmetrically worn surface of the tip end of the writing lead is increased. Consequently, a phenomenon occurs in which lines that are drawn on the surface of the sheet of paper after the area of the unsymmetrically worn surface is increased will become thick as compared to lines which were drawn on the surface of the sheet of paper when the writing was commenced. Moreover, a phenomenon occurs in which the increase in the area of the unsymmetrically worn surface of the tip end of the writing lead will produce blurred areas in the drawn lines.

In order to solve these problems, there has been proposed a writing lead rotating mechanism which allows a chuck unit, disposed in a tubular shaft of a mechanical pencil and always biased forward, and a writing lead held by the chuck unit to be rotated in a circumferential direction, as the chuck unit is moved rearward by a writing force produced by pushing the writing lead against the surface of the sheet of paper, or the chuck unit is moved forward when the writing lead is released from the writing force (refer to Patent Literature 1).

The writing lead rotating mechanism of the mechanical pencil described in the Patent Literature 1 includes a rotary element rotatably disposed in the tubular shaft and adapted to be rotated together with the chuck unit, the rotary element having a first cam face formed at a rear end thereof and a second cam face formed at a tip end thereof, a first stationary cam face provided in the tubular shaft and disposed on a rear end side of the first cam face so as to face the first cam face, and a second stationary cam face provided in the tubular shaft and disposed on a tip end side of the second cam face so as to face the second cam face. As the chuck unit is moved rearward in the tubular shaft by application of the writing force to the writing lead, the first cam face of the rotary cam element is operatively engaged with the first stationary cam face, whereby the rotary cam element is rotated at a fixed rotational angle in the circumferential direction. Thereby, the writing lead held by the chuck unit is rotated at the fixed rotational angle in the circumferential direction. Moreover, when the chuck unit is moved forward in the tubular shaft by release of the writing force applied to the writing lead, the second cam face of the rotary cam element is operatively engaged with the second stationary cam face, whereby the rotary cam element is rotated at the fixed rotational angle in the circumferential direction. Thereby, the writing lead held by the chuck unit is rotated at the fixed rotational angle in the circumferential direction. By causing the writing lead to be rotated using the writing force in this way, it is possible to suppress an increase in an area of an unsymmetrical wearing surface of a tip end of the writing lead.

CITATION LIST

Patent Literature

Patent Literature 1: WO 2007/142135 A1

SUMMARY OF INVENTION

Technical Problems

Incidentally, the writing force will be varied depending upon users of mechanical pencils, and unsymmetrical wearing-manner of the tip end of the writing lead will be also varied in accordance with the strength and weakness of the writing force.

In the mechanical pencil described in the Patent Literature 1, the rotational angle at which the writing lead is rotated by the application or release of the writing force with a single operation is set so as to be always constant independently from the strength and weakness of the writing force. Therefore, in this mechanical pencil, it is impossible to control the rotational angle of the writing lead in such a manner that the rotational angle of the writing lead responds to the unsymmetrical wearing manner of the writing lead which depends upon the strength and weakness of the writing force.

It is, therefore, an object of the present invention to provide a mechanical pencil which allows a writing lead to be rotated at a suitable rotational angle commensurate to the variation of the writing force.

Solution to Problems

The present invention has been made in order to achieve the above-mentioned object and has the following aspects.

Incidentally, reference signs which are herein employed are reference signs used only for explanation of embodiments of the present invention and do not limit the technical scope of the present invention.

(First Aspect of the Present Invention)

In accordance with a first aspect of the present invention, there is provided a mechanical pencil comprising:

a tubular shaft (11);

a chuck unit (20) for releasably holding a writing lead (L);

a front rotary element (31) provided in the tubular shaft (11);

a rear rotary element (32) provided in the tubular shaft (11) so as to be disposed rearward of the front rotary element (31);

the chuck unit (20) being movably arranged in the tubular shaft (11) so as to be inserted through the front rotary element (31) and the rear rotary element (32);

the front rotary element (31) being adapted to be moved rearward according to rearward movement of the chuck unit (20);

the rear rotary element (32) being adapted to be moved rearward according to the rearward movement of the front rotary element (31);

a conversion means (40) for causing the rear rotary element (31) to be rotated in one of circumferential directions (hereinafter referred to as "a normal directional rotation") as the rear rotary element (32) is moved rearward and for causing the rear rotary element (32) to be rotated in the other of the circumferential directions (hereinafter referred to as "a reverse rotational direction") as the rear rotary element (32) is moved forward;

a normal directional rotation transmitting means (41) for allowing the front rotary element (31) to be rotated in the normal rotational direction as the rear rotary element is rotated in the normal rotational direction and for allowing the rear rotary element (32) to be idly rotated with respect to the front rotary element (31) at the time of reverse directional rotation of the rear rotary element (32); and a reverse directional rotation restricting means (46) allowing normal directional rotation of the front rotary element (31) but preventing reverse directional rotation of the front rotary element (31).

According to the first aspect of the present invention, when a writing force is applied to the writing lead (L), the chuck unit (20), the front rotary element (31), and the rear rotary element (32) are moved rearward in the tubular shaft (11). According to the rearward movement of them, the rear rotary element (32) is rotated in the normal rotational direction by the conversion means (40). Moreover, according to the normal directional rotation of the rear rotary element (32), the front rotary element (31) is rotated in the normal rotational direction by the normal directional rotation transmitting means (41) and the reverse directional rotation restricting means (46) allowing the normal directional rotation of the front rotary element (31). Moreover, by the normal directional rotation of the front rotary element (31), the chuck unit (20) is rotated in the normal rotational direction and the writing lead (L) held by the chuck unit (20) is also rotated in the normal rotational direction.

On the other hand, when the writing lead (L) is released from the writing force, the chuck unit (20), the front rotary element (31), and the rear rotary element (32) are moved forward in the tubular shaft (11). According to the forward movements of them, the rear rotary element (32) is rotated in the reverse rotational direction by the conversion means (40) and the normal directional rotation transmitting means (41). However, the front rotary element (31) is prevented from being rotated in the reverse rotational direction by the reverse directional rotation restricting means (46). Therefore, the chuck unit (20) and the writing lead (L) are also not rotated in the reverse rotational direction and rotational positions of them are maintained.

(Second Aspect of the Present Invention)

According to a second aspect of the present invention, the mechanical pencil further includes a stationary member (14) inserted in a rear end portion of the rear rotary element (32) and fixed with respect to the tubular shaft (11), and the conversion means (40) comprises engagement protrusions (14*d*) projecting from one of the stationary member (14) and the rear rotary element (32) toward the other of the stationary member (14) and the rear rotary element (32), and the through-holes (32*c*) or inner peripheral grooves formed in the other of the stationary member (14) and rear rotary element (32) so as to circumferentially obliquely extend, the through-holes (32*c*) or inner peripheral grooves being engaged with the engagement protrusions (14*d*).

The conversion means (40) may comprise engagement protrusions (14*d*) projecting from an outer peripheral surface of the stationary member (14), and through-holes (32*c*) or inner peripheral grooves formed in the rear rotary element (32). Moreover, the conversion means (40) may comprise engagement protrusions (14*d*) provided on the inner peripheral surface of the rear rotary element (32), and through-holes (32*c*) or inner peripheral grooves formed in the stationary member (14).

(Third Aspect of the Present Invention)

According to a third aspect of the present invention, the conversion means (40) comprises engagement protrusions projecting from one of the rear rotary element (32) and tubular shaft (11) toward the other of the rear rotary element (32) and the tubular shaft (11), and through-holes or inner peripheral grooves formed in the other of the rear rotary element (32) and the tubular shaft (11) so as to circumferentially obliquely extend, the through-holes or inner peripheral grooves being engaged with the engagement protrusions.

The conversion means (40) may comprise engagement protrusions projecting from the outer peripheral surface of the rear rotary element (32), and through-holes or inner peripheral grooves formed in the tubular shaft (11). Moreover, the conversion means (40) may comprise engagement protrusions provided on the inner peripheral surface of the tubular shaft (11), and through-holes or inner peripheral grooves formed in the rear rotary element (32).

(Fourth Aspect of the Present Invention)

According to a fourth aspect of the present invention, the rear rotary element (32) is inserted in the front rotary element (31), and the normal directional rotation transmitting means (41) comprises a first elastic piece (42) provided at the rear rotary element (32) so as to extend in a circumferential direction of the rear rotary element (32) and having a first ratchet pawl (43) provided at an end of the first elastic piece (42) in a circumferentially extending direction of the first elastic piece, and a plurality of first axially extending ratchet teeth (44) disposed around an inner peripheral surface of the front rotary element (31), the first ratchet pawl (43) being adapted to be selectively engageable with the plurality of first axially extending ratchet teeth (44).

(Fifth Aspect of the Present Invention)

According to a fifth aspect of the present invention, the front rotary element (31) is inserted in the rear rotary element (32), and the normal directional rotation transmitting means (41) comprises a first elastic piece provided at the front rotary element (31) so as to extend in a circumferential direction of the front rotary element (31) and having a first ratchet pawl provided at an end of the first elastic piece in a circumferentially extending direction of the first elastic piece, and a plurality of first axially extending ratchet teeth disposed around an inner peripheral surface of the rear rotary element (32), the first ratchet pawl being adapted to be selectively engageable with the plurality of first axially extending ratchet teeth.

(Sixth Aspect of the Present Invention)

According to a sixth aspect of the present invention, the mechanical pencil further includes a slider (26) allowing the writing lead (L) to pass therethrough and inserted in a tip end portion of the tubular shaft (11) so as to be relatively rotatable with respect to the tubular shaft (11), and inserted in the front rotary element (31) so as to be relatively unrotatable with respect to the front rotary element (31), and the reverse directional rotation restricting means (46) comprises a second elastic piece (47) provided at the slider (26) so as to extend in a circumferential direction of the slider (26) and having a second ratchet pawl (48) provided at an end of the second elastic piece (47) in the circumferentially extending direction of the second elastic piece (47), and a plurality of second axially extending ratchet teeth (49) provided around an inner peripheral surface of the tubular shaft (11), the second ratchet pawl (48) being adapted to be selectively engageable with the plurality of second axially extending ratchet teeth (44).

(Seventh Aspect of the Present Invention)

According to a seventh aspect of the present invention, the mechanical pencil further includes a slider (26) allowing the writing lead (L) to pass therethrough and inserted in a tip end portion of the tubular shaft (11) so as to be relatively unrotatable with respect to the tubular shaft (11), and inserted in the front rotary element (31) so as to be relatively rotatable with respect to the front rotary element (31), and the reverse directional rotation restricting means (46) comprises a second elastic piece (57) provided at the front rotary element (31) so as to extend in a circumferential direction of the front rotary element (31) and having a second ratchet pawl (58) provided at an end of the second elastic piece (57) in a circumferentially extending direction of the second elastic piece (57), and a plurality of second axially extending ratchet teeth (59) provided around an inner peripheral surface of the slider (26), the second ratchet pawl (58) being adapted to be selectively engageable with the plurality of second ratchet teeth (59).

(Eighth Aspect of the Present Invention)

According to an eighth aspect of the present invention, the reverse directional rotation restricting means (46) comprises a second elastic piece provided at the front rotary element so as to extend in a circumferential direction of the front rotary element and having a second ratchet pawl provided at an end of the second elastic piece in the circumferentially extending direction of the second elastic piece, and a plurality of second axially extending ratchet teeth disposed around an inner peripheral surface of the tubular shaft, the second ratchet pawl being adapted to be selectively engageable with the plurality of second axially extending ratchet teeth.

Advantageous Effects of Invention

According to the present invention, when the writing force is relatively weakly applied to the writing lead, a rearward moving distance of the rear rotary element in the tubular shaft is short and a rotational angle of the rear rotary element is small in proportion to the short rearward-moving distance of the rear rotary element, so that the writing lead is allowed to be rotated at a small rotational angle. On the other hand, when the writing force is relatively strongly applied to the writing lead, the rearward moving distance of the rear rotary element in the tubular shaft is long and the rotational angle of the rear rotary element is large in proportion to the long rearward-moving distance of the rear rotary element, so that the writing lead is allowed to be rotated at a large rotational angle.

Therefore, the writing lead can be rotated at a suitable rotational angle commensurate to the variation of the writing force.

DETAILED DESCRIPTION OF THE EMBODIMENTS

Next, mechanical pencils according to embodiments of the present invention will be discussed hereinafter. Incidentally, in each of the mechanical pencils according to the embodiments, a side toward which a writing lead is advanced in an axial direction of a tubular shaft of the mechanical pencil shall be referred to as "a tip end side" and an opposite side shall be referred to as "a rear end side".

(First Embodiment)

A mechanical pencil according to a first embodiment of the present invention will be discussed hereinafter with reference to FIGS. 1-15.

Figure 1:
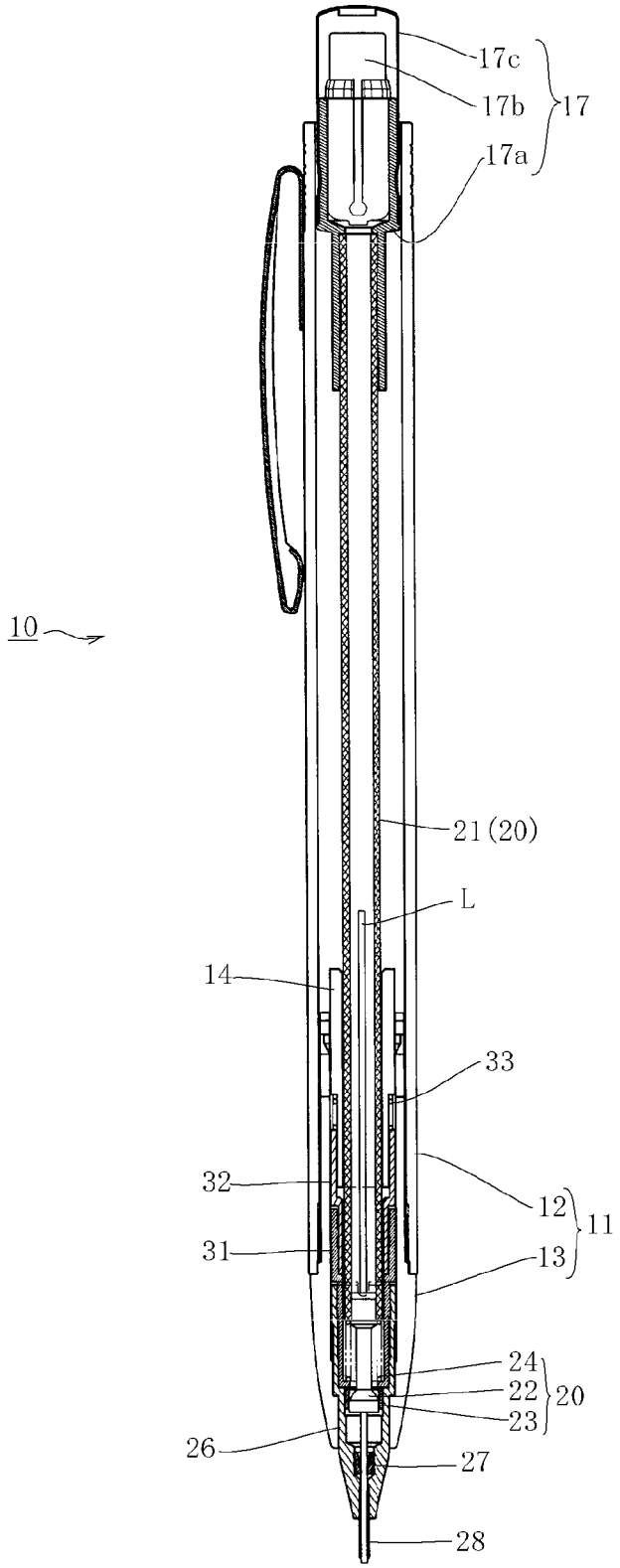
FIG. 1 is a vertically sectional view of a mechanical pencil according to a first embodiment of the present invention.
Figure 2:
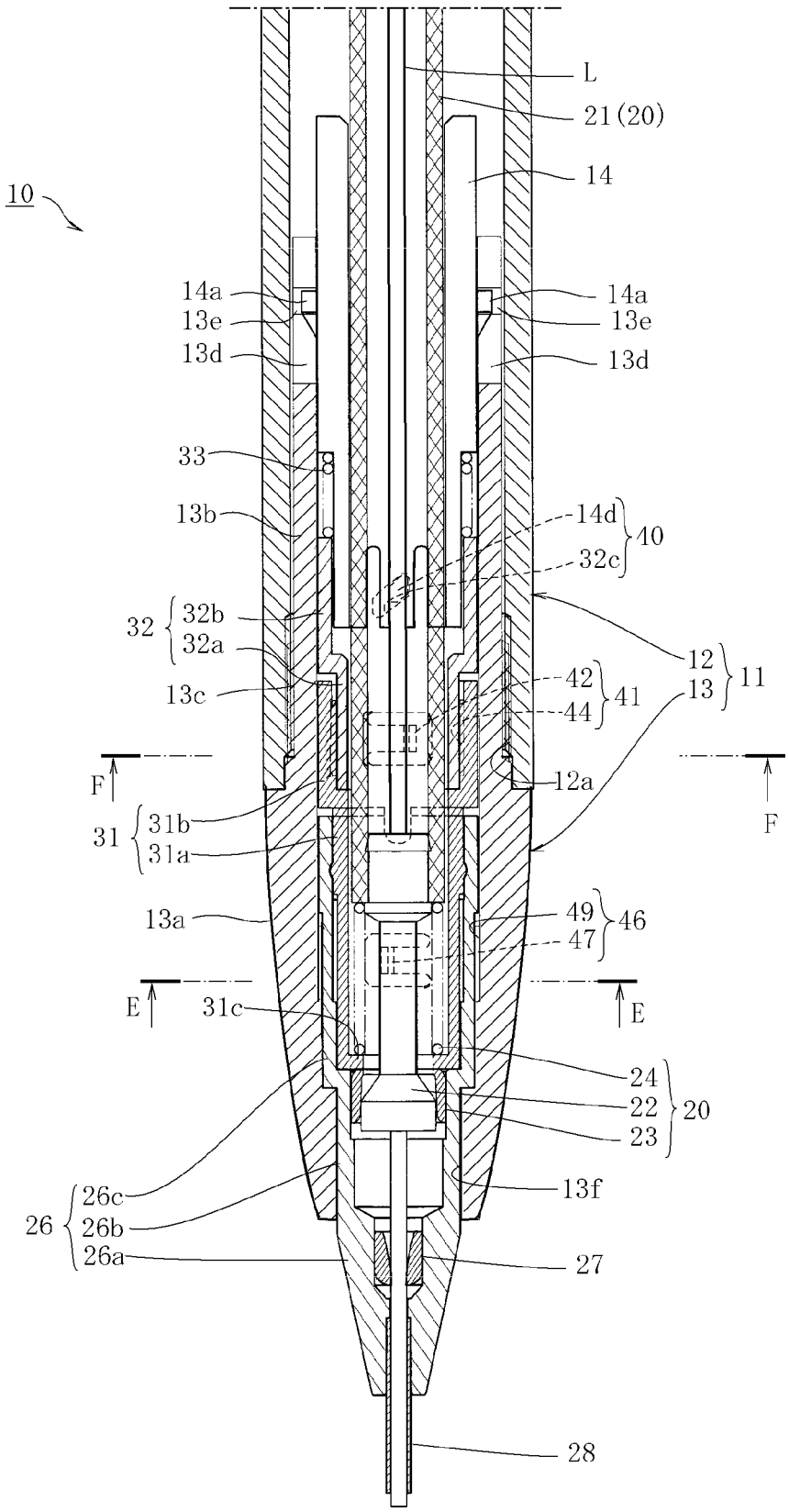
FIG. 2 is a vertically sectional enlarged view of a tip end portion of the mechanical pencil shown in FIG. 1.

As shown in FIGS. 1 and 2, the mechanical pencil 10 includes a hollow tubular shaft 11, and a chuck unit 20 disposed in the tubular shaft 11 for releasably holding a writing lead L.

The chuck unit 20 includes a tubular case (a writing lead storage case) 21 for storing writing leads therein, a chuck member 22 fixedly mounted to a tip end portion of the writing lead storage case 21 for releasably holding the writing lead L, the chuck member 22 having a tip end portion which includes holding pieces configured to be elastically opened relative to one another and adapted to be releasably hold the writing lead L, an annular chuck ring 23 fitted around the tip end portion of the chuck member 22 so as to cause the holding pieces to be closed relative to one another, and a chuck spring 24 for biasing the chuck member 22 and the writing lead storage case 21 in a rearward direction. As shown in FIG. 1, a knocking member 17 is connected to a rear end portion of the writing lead storage case 21 so as to partially project rearward from the rear end of the tubular shaft 11. The knocking member 17 of this embodiment includes a receiver base 17*a* mounted on the rear end portion of the writing lead storage case 21, an eraser 17*b* fitted in the receiver base 17*a*, and a cover 17*c* mounted on the receiver base 17*a* so as to cover the eraser 17*b*.

In the mechanical pencil 10, when the knocking member 17 is operated so as to be pushed toward a tip end side in an axial direction of the tubular shaft 11, the writing lead storage case 21 and the chuck member 22 are moved forward in the tubular shaft 11 against a biasing force of the chuck spring 24. As the writing lead storage case 21 and the chuck member 22 are moved forward in this way, the holding pieces of the chuck member 22 are elastically opened relative to one another while advancing the writing lead L and being projected forward with respect to the chuck ring 23, whereby the chuck member 22 is brought into a state where it releases the writing lead L therefrom. On the other hand, when the knocking member 17 is released from the pushing operation, the writing lead storage case 21 and the chuck member 22 are moved rearward in the tubular shaft 11 by the biasing force of the chuck spring 24. As the chuck member 22 is moved rearward, the holding pieces of the chuck member 22 are closed relative to one another while being retracted in the chuck ring 23, whereby the chuck member 22 is brought into a state where it again holds the writing lead L.

Figure 4:
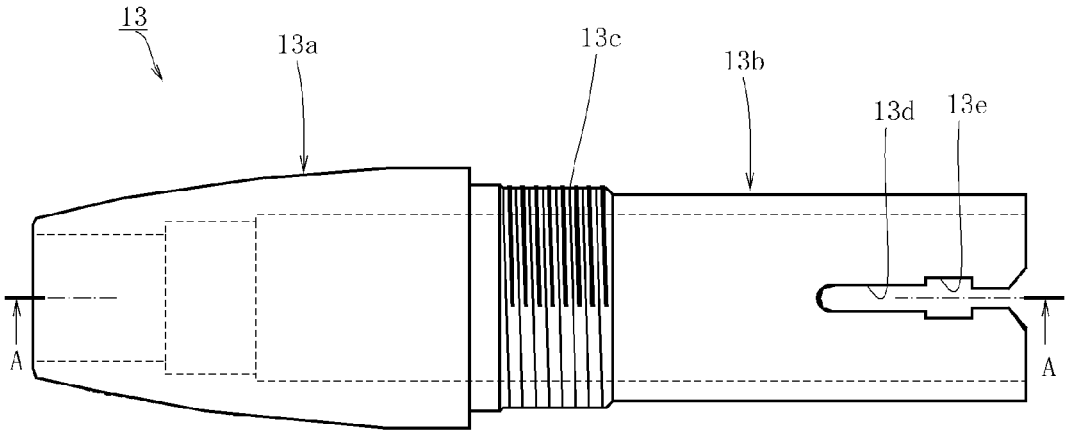
FIG. 4 is a side view of a tip member of the mechanical pencil according to the first embodiment.

As shown in FIGS. 1 and 2, the tubular shaft 11 includes a tubular shaft body 12 opened at tip and rear ends thereof, and a hollow tip member 13 mounted to a tip end of the tubular shaft body 12. As shown in FIGS. 2 and 4, the tip member 13 includes a tapered portion 13*a* and a tubular insertion portion 13*b* inserted in the tubular shaft body 12. The tapered portion 13*a* has an outer peripheral surface extending so as to be contiguous to an outer peripheral surface of the tubular shaft body 12 and smoothly tapered toward a tip end of the tip member 13. The insertion portion 13*b* extends rearward from a rear end of the tapered portion 13*a* and has an outer peripheral surface whose diameter is step-wise reduced. In this embodiment, as shown in FIG. 2, the tubular shaft body 12 has an internal thread 12*a* provided around an inner peripheral surface of the tip end portion thereof, and the insertion portion 13*b* has an external thread 13*c* provided around an outer peripheral surface of a tip end portion thereof. By threaded-engagement between the internal thread 12*a* and the external thread 13*c*, the tubular shaft body 12 and the tip member 13 are fixedly connected to each other. However, the tubular shaft body 12 and the tip member 13 may be fixedly connected to each other by other conventional connecting processes. Moreover, the insertion portion 13*b* of the tip member 13 has a pair of slits 13*d* extending toward the tip end side of the insertion portion 13*b* from a rear end edge of the insertion portion 13*b* and disposed at locations radially opposite to each other. The slits 13*d* have circumferentially increased width portions 13*e* at middle positions thereof in an axial direction.

Figure 3:
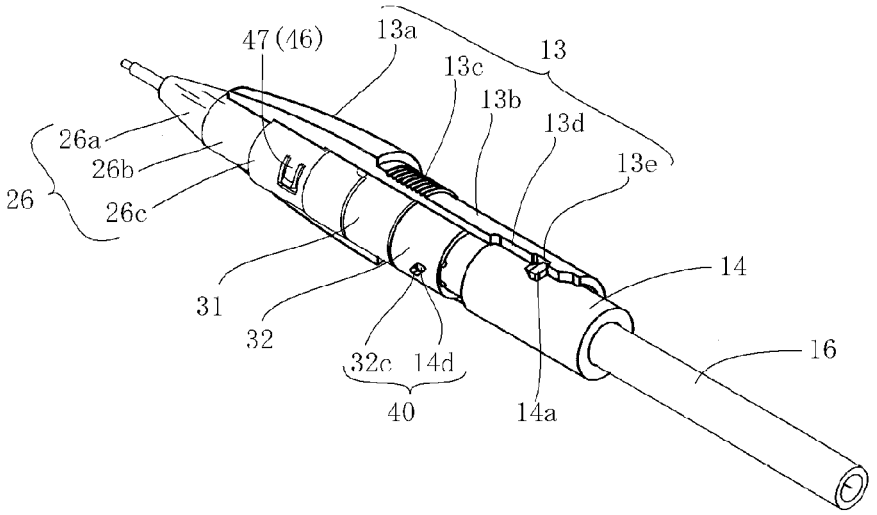
FIG. 3 is a partially broken perspective view of the tip end portion of the mechanical pencil according to the first embodiment.

As shown in FIGS. 2 and 3, a slider 26 through which the writing lead L can pass is inserted in the tip member 13 so as to be capable of being partially projected out from a tip end opening of the tapered portion 13*a* of the tip member 13. Moreover, a stationary member 14 through which the writing lead storage case 21 is inserted is fixed with respect to the insertion portion 13*b* of the tip member 13. A front rotary element 31 and a rear rotary element 32 are provided between the slider 26 and the stationary member 14 in the tubular shaft 11. The front rotary element 31 is mounted on an outer peripheral surface of the tip end portion of the writing lead storage case 21 so as to cover an outer peripheral surface of the chuck spring 24. The rear rotary element 32 through which the writing lead storage case 21 is inserted is arranged at a rear end portion thereof around a tip end portion of the stationary member 14 and inserted at a tip end portion thereof in a rear end portion of the front rotary element 31. The slider, the stationary member, and the rotary elements will be explained in detail hereinafter.

Figure 5:
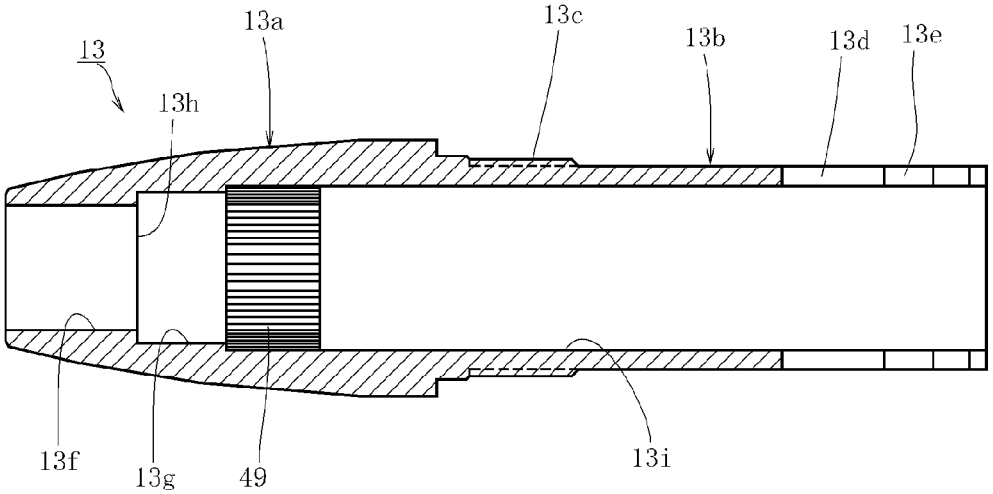
FIG. 5 is an A-A sectional view of FIG. 4.
Figure 6:
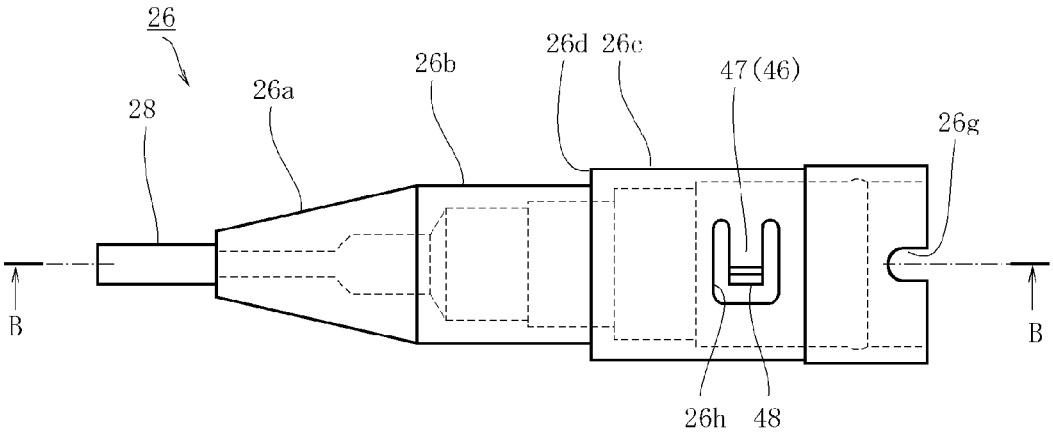
FIG. 6 is a side view of a slider of the mechanical pencil according to the first embodiment.
Figure 7:
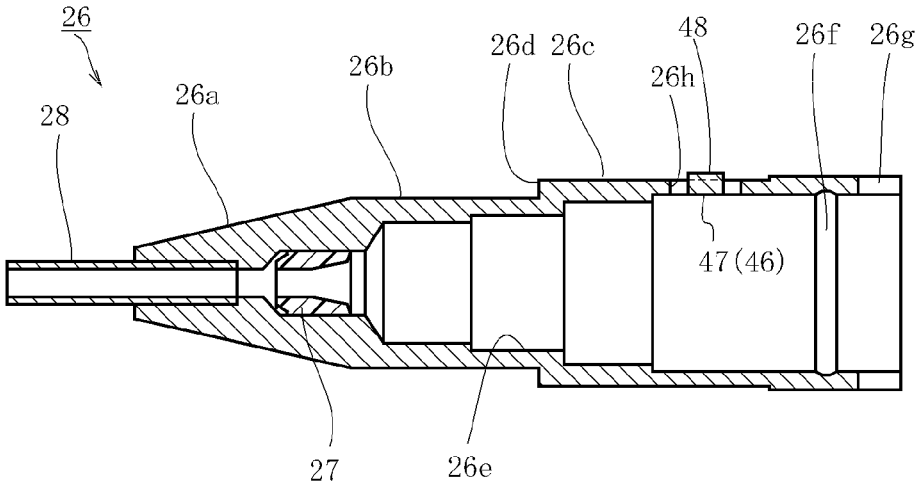
FIG. 7 is a B-B sectional view of FIG. 6.

As shown in FIGS. 6 and 7, the slider 26 includes a tapered tip end portion 26*a* whose outer diameter is tapered toward the tip end of the slider 26, a middle barrel portion 26*b*, and a rear end portion 26*c*. The middle barrel portion 26*b* extends rearward from the rear end of the tip end portion 26*a* and has a substantially constant outer diameter. The rear end portion 26*c* extends rearward from the rear end of the middle barrel portion 26*b* and has an outer peripheral surface whose diameter is step-wise increased toward the rear end of the rear end portion 26*c* from the rear end of the middle barrel portion 26*b*. As shown in FIG. 5, the tip member 13 has an inner peripheral surface whose diameter is step-wise increased toward the rear end of the tip member 13 from the tip end of the tip member 13. More particularly, the tip member 13 has a small diameter bore 13*f*, a middle diameter bore 13*g*, and a large diameter bore 13*i* which are arranged in turn from the tip end to the rear end of the tip member 13. The small diameter bore 13*f* is formed so as to allow the tip end portion 26*a* and middle barrel portion 26*b* of the slider 26 to pass therethrough but so as not to allow the rear end portion 26*c* of the slider 26 to pass therethrough. The middle diameter bore 13*g* and the large diameter bore 13*i* are formed so as to allow the tip end portion 26*a*, middle barrel portion 26*b*, and rear end portion 26*c* of the slider 26 to pass therethrough. As shown in FIG. 2, the slider 26 which is inserted in the tip member 13 from a rear end opening of the tip member 13 is partially projected out from the tip end opening of the tip member 13. However, an outer step portion 26*d* (refer to FIG. 6) between the middle barrel portion 26*b* and rear end portion 26*c* of the slider 26 is abutted against an inner step portion 13*h* (refer to FIG. 5) between the small diameter bore 13*f* and middle diameter bore 13*g* of the tip member 13, whereby the slider 26 is prevented from moving forward relative to the tip member 13.

As shown in FIG. 7, the slider 26 has an inner peripheral surface whose diameter is step-wise increased toward the rear end of the slider 26 from the tip end of the slider 26. The slider 26 has a receiving portion 26*e* defined at a middle location of an interior thereof in the axial direction for receiving the chuck ring 23. Moreover, the slider 26 has an engagement recess portion 26*f* formed circumferentially around an inner peripheral surface of the rear end portion 26*c* thereof so as to be annularly recessed. In addition, a writing lead return stopper member 27 which can hold the writing lead L when the holding pieces of the chuck member 22 are opened relative to one another to release the writing lead L therefrom is provided in the tip end portion 26*a* of the slider 26. Incidentally, although a guide pipe 28 through which the writing lead L passes is inserted in the tip end portion 26*a* of the slider 26, the guide pipe 28 is not always required to be provided. As shown in FIG. 6, the slider 26 is formed with notch portions 26*g* extending toward the tip end portion 26*a* thereof from a rear end edge thereof. The notch portions 26*g* are adapted to be engaged with extension portions 31*e* of the front rotary element 31 which will be described below.

Figure 10:
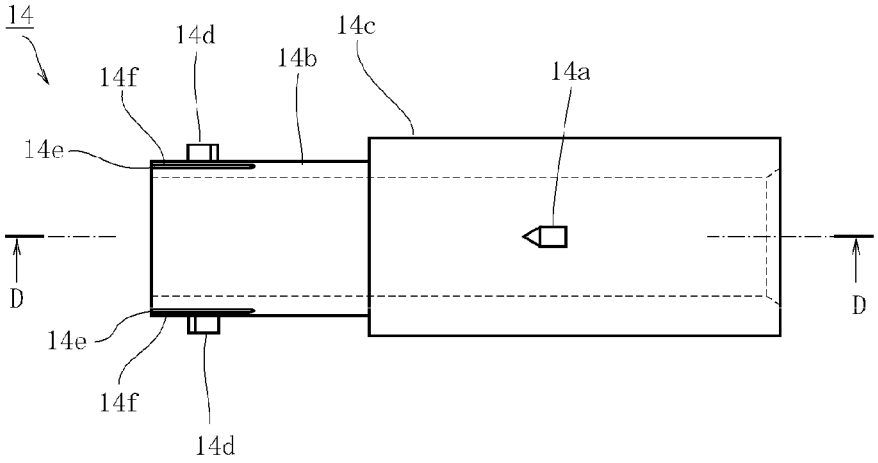
FIG. 10 is a side view showing a stationary member of the mechanical pencil according to the first embodiment.
Figure 11:
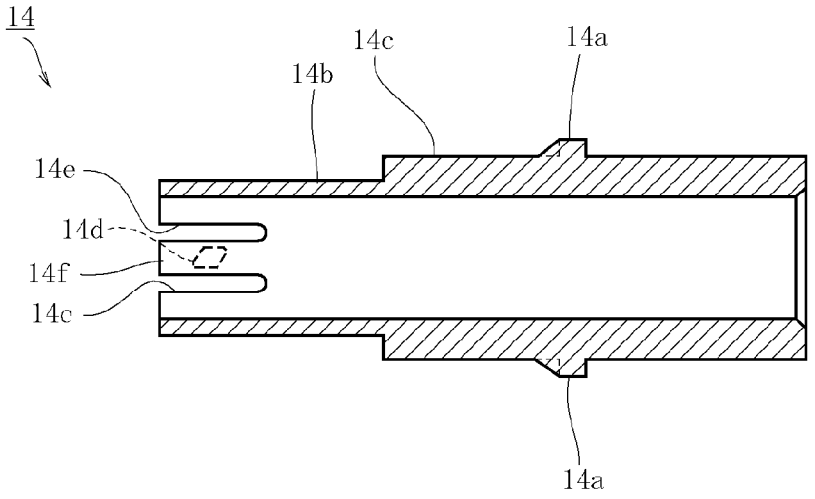
FIG. 11 is a D-D sectional view of FIG. 10.

As shown in FIGS. 10 and 11, the stationary member 14 is formed into a tubular shape and has tip and rear end openings. The writing lead storage case 21 is inserted through an interior of the stationary member 14 so as to be circumferentially rotatable and axially movable (refer to FIG. 2). More particularly, the stationary member 14 includes a large diameter portion 14*c* inserted in the tubular insertion portion 13*b* of the tip member 13, and a small diameter portion 14*b* which extends forward from a tip end of the large diameter portion 14*c* and whose outer diameter is step-wise reduced. The small diameter portion 14*b* of the stationary member 14 is configured to be capable of being inserted in the rear rotary element 32 (refer to FIG. 2) which will be described below. A pair of radially outward projecting engagement protrusions 14*a* is provided on an outer peripheral surface of the large diameter portion 14*c*. The engagement protrusions 14*a* of the stationary member 14 are engaged with the circumferentially increased width portions 13*e* of the slits 13*d* of the tip member 13 which have been briefly described above, whereby the stationary member 14 is attached to the tip member 13 so as to be circumferentially unrotatable and axially unmovable with respect to the tip member 13. Namely, the stationary member 14 is fixed with respect to the tubular shaft 11 including the tip member 13.

Figure 8:
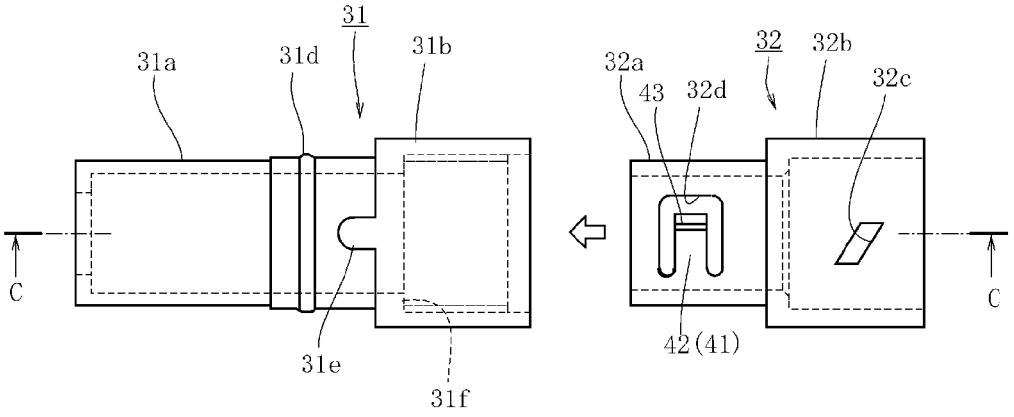
FIG. 8 is a side view showing front and rear rotary elements of the mechanical pencil according to the first embodiment.
Figure 9:
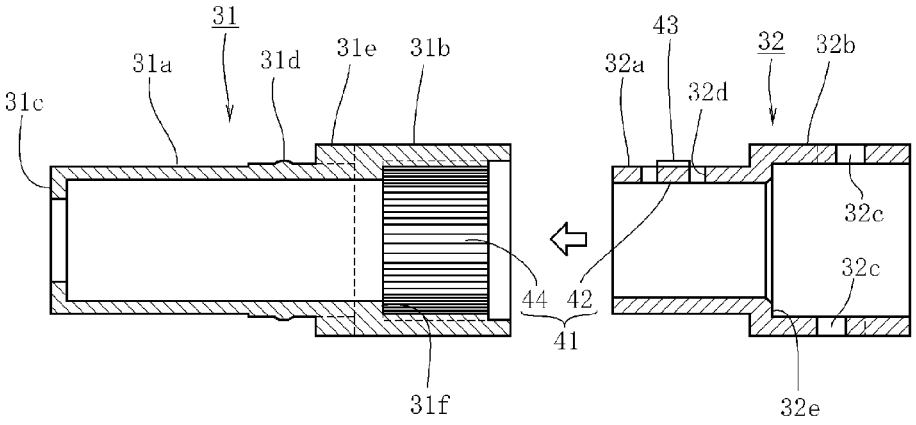
FIG. 9 is a C-C sectional view of FIG. 8.

As shown in FIGS. 8 and 9, the front rotary element 31 includes a first tubular portion 31*a* inserted in the rear end portion 26*c* of the slider 26, and a second tubular portion 31*b* which extends rearward from a rear end of the first tubular portion 31*a* and whose outer diameter is step-wise increased from the rear end of the first tubular portion 31*a*. A radially inward protruding flange portion 31*c* is formed around an inner peripheral surface of a tip end of the first tubular portion 31*a*. The chuck member 22 is disposed in the front rotary element 31 in the state where the tip end portion of the chuck member 22 around which the chuck ring 23 is fitted is positioned forward of a bore which is surrounded by a protruding edge of the flange portion 31*c* of the front rotary element 31 (refer to FIG. 2). The chuck spring 24 is disposed between a rear end surface of the flange portion 31*c* of the front rotary element 31 and a tip end edge of the writing lead storage case 21 and biases the chuck member 22, fixedly connected to the writing lead storage case 21 as described above, in the rearward direction. The chuck ring 23 which is mounted on the tip end portion of the chuck member 22 is abutted against the flange portion 31*c* of the front rotary element 31, whereby the front rotary element 31 and the chuck unit 20 are adapted to be engaged with each other.

As shown in FIGS. 8 and 9, the first tubular portion 31*a* of the front rotary element 31 has a radially outward protruding engagement convex portion 31*d* annularly formed around an outer peripheral surface thereof. As briefly described above, the outer peripheral surface of the first tubular portion 31*a* has the extension portions 31*e* which extend toward the tip end of the first tubular portion 31*a* from the tip end edge of the second tubular portion 31*b*. The engagement convex portion 31*d* of the front rotary element 31 and the extension portions 31*e* of the front rotary element 31 are engaged in the engagement recess portion 26*f* (refer to FIG. 7) of the slider 26 and the notch portions 26*g* (refer to FIG. 7) of the slider 26, respectively, whereby the front rotary element 31 and the slider 26 are connected to each other so as to be circumferentially unrotatable relative to each other. The front rotary element 31 has a step portion 31*f* formed around an inner peripheral surface of the second tubular portion 31*b* thereof. Moreover, a plurality of first axially extending ratchet teeth 44 which will be described in detail below are formed circumferentially around the inner peripheral surface of the second tubular portion 31*b* of the front rotary element 31.

As shown in FIGS. 8 and 9, the rear rotary element 32 includes a first tubular portion 32*a* inserted in the second tubular portion 31*b* of the front rotary element 31, and a second tubular portion 32*b* which extends from a rear end of the first tubular portion 32*a* of the rear rotary element 32 and whose outer diameter is step-wise increased from the rear end of the first tubular portion 32*a* of the rear rotary element 32. The rear rotary element 32 which is inserted in the front rotary element 31 from a rear end opening of the front rotary element 31 is abutted at a tip end edge of the rear rotary element 32 against the step portion 31*f* of the front rotary element 31, whereby the rear rotary element 32 is prevented from moving forward (refer to FIG. 2). Incidentally, the rear end edge of the front rotary element 31 and the tip end edge of the second tubular portion 32*b* of the rear rotary element 32 may be configured to be abutted against each other. As shown in FIG. 9, the rear rotary element 32 has a step portion 32*e* which is circumferentially formed around a tip end of the inner peripheral surface of the second tubular portion 32*b*.

Figure 12:
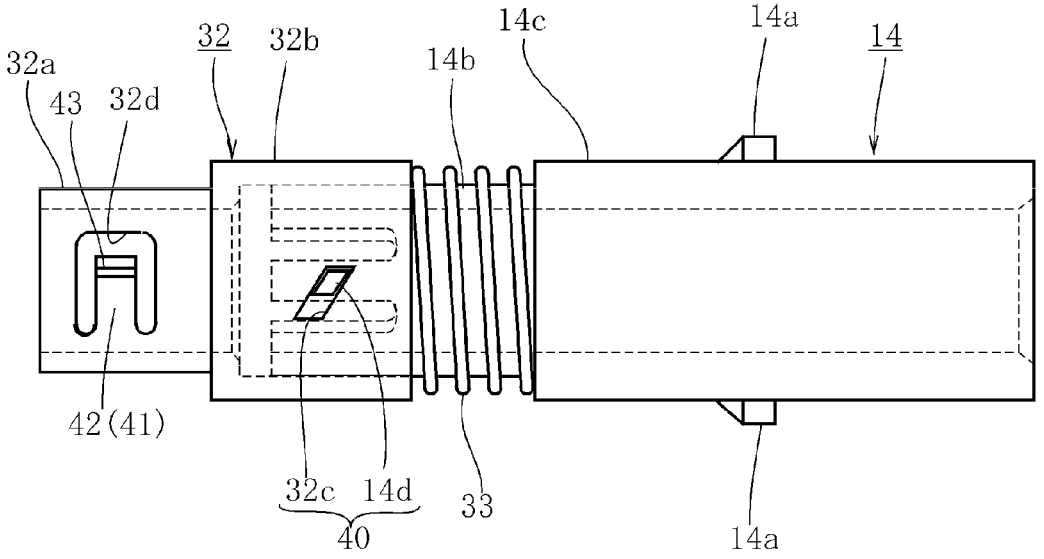
FIG. 12 is a side view which shows the rear rotary element, stationary member, and spring of the mechanical pencil according to the first embodiment in a state where a writing force is not applied to a writing lead.

As shown in FIG. 12, the small diameter portion 14*b* of the stationary member 14 is partially inserted in the second tubular portion 32*b* of the rear rotary element 32. A return spring 33 which is mounted around an outer peripheral surface of the small diameter portion 14*b* of the stationary member 14 is disposed between the rear end of the second tubular portion 32*b* of the rear rotary element 32 and the tip end edge of the large diameter portion 14*c* of the stationary member 14. The return spring 33 always biases the rear rotary element 32 forward. By the forward biasing action of the return spring 33 on the rear rotary element 32, the front rotary element 31, the slider 26, and the chuck unit 20 are also biased forward. When the writing lead L held by the chuck member 22 is pushed rearward by a writing force which is applied to the writing lead L, the chuck unit 20, the slider 26, the front rotary element 31, and the rear rotary element 32 are adapted to be moved rearward against the biasing force of the return spring 33 in the tubular shaft 11.

As shown in FIGS. 9-12, the stationary member 14 has a pair of radially outward projecting engagement protrusions 14*d* provided on the outer peripheral surface thereof, and the rear rotary element 32 has a pair of through-holes 32*c* formed in the second tubular portion 32*b* thereof. The through-holes 32*c* of the rear rotary element 32 are engaged with the engagement protrusions 14*d* of the stationary member 14 so as to be slidable with respect to the engagement protrusions 14*d*. The engagement protrusions 14*d* and the through-holes 32*c* serve as a conversion means 40 which converts axial movement of the front rotary element 31 and the rear rotary element 32 into rotational movement of them. The engagement protrusions 14*d* and the through-holes 32*c* will be explained in detail hereinafter.

As shown in FIGS. 10 and 11, the small diameter portion 14*b* of the stationary member 14 is formed with first and second pairs of slits 14*e* which extend toward the rear end of the small diameter portion 14*b* from the tip end of the small diameter portion 14*b*. A region of the small diameter portion 14*b* which is interposed between the first pair of slits 14*e* forms an elastically deformable swing piece 14*f*. Similarly, a region of the small diameter portion 14*b* which is interposed between the second pair of slits 14*e* forms an elastically deformable swing piece 14*f*. Each of the radially outward protruding engagement protrusions 14*d* briefly discussed above is formed on an outer surface of a corresponding swing piece 14*f*. When the small diameter portion 14*b* of the stationary member 14 is inserted into the second tubular portion 32*b* of the rear rotary element 32 for assembling, the swing pieces 14*f* of the stationary member 14 are moved forward in the second tubular portion 32*b* of the rear rotary element 32 while being elastically deformed in a radially inward direction. As the swing pieces 14*f* are moved forward while being elastically deformed in the radially inward direction by the insertion of the small diameter portion 14*b* of the stationary member 14 into the second tubular portion 32*b* of the rear rotary element 32, the engagement protrusions 14*d* become operatively engaged in the through-holes 32*c* of the second tubular portion 32*b* of the rear rotary element 32. Then, the swing pieces 14*f* elastically return to the original states thereof.

Figure 13:
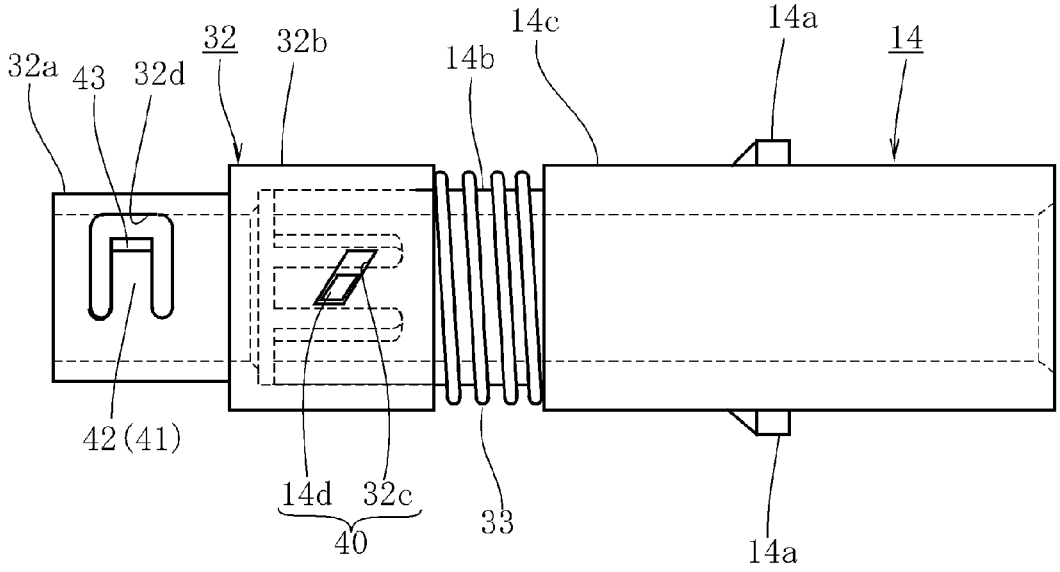
FIG. 13 is a side view which shows the rear rotary element, stationary member, and spring of the mechanical pencil according to the first embodiment in a state where the writing force is applied to the writing lead.

As shown in FIGS. 8 and 9, the through-holes 32*c* briefly discussed above are formed in regions of the second tubular portion 32*b* of the rear rotary element 32 which are radially opposite to each other. As shown in FIGS. 12 and 13, the through-holes 32*c* of the rear rotary element 32 are engaged with the engagement protrusions 14*d* of the swing pieces 14*f* so as to be slidable with respect to the engagement protrusions 14*d* of the swing pieces 14*f*. Each of the through-holes 32*c* extends so as to be inclined with respect to the circumferential direction of the rear rotary element 32. More particularly, the through-hole 32*c* is inclined rearward as it extends in a normal rotational direction of the rear rotary element 32 (a direction indicated by an arrow N in FIG. 15, i.e., a counterclockwise direction). Incidentally, although the through-holes 32*c* are formed so as to penetrate the rear rotary element 32 in a thickness direction of a wall of the rear rotary element 32 in this embodiment, inner peripheral grooves which are recessed in the inner peripheral surface of the second tubular portion 32*b* of the rear rotary element 32 may be employed in lieu of the through-holes.

As the rear rotary element 32 in a state shown in FIG. 12 is moved rearward against the biasing force of the return spring 33 by a writing force that is applied to the tip end of the writing lead L, the inclined through-holes 32*c* of the rear rotary element 32 are slid with respect to the engagement protrusions 14*d* of the stationary member 14, whereby the rearward movement of the rear rotary element 32 is converted into rotational movement of the rear rotary element 32 in the normal rotational direction N. Thus, the through-holes 32*c* of the rear rotary element 32 are brought into states shown in FIG. 13 from states shown in FIG. 12. As the through-holes 32*c* are slid with respect to the engagement protrusions 14*d* in this way, the rear rotary element 32 is rotated in the normal rotational direction N. Incidentally, it is preferable that the step portion 32*e* of the rear rotary element 32 should be adapted to be abutted against the tip end of the small diameter portion 14*b* of the stationary member 14 when the rear rotary element 32 is moved rearward in such a manner to allow the through-holes 32*c* of the rear rotary element 32 to be slid to the utmost level with respect to the engagement protrusions 14*d* of the stationary member 14, or when the rear rotary element 32 is moved rearward until immediately before the through-holes 32*c* of the rear rotary element 32 are slid to the utmost level with respect to the engagement protrusions 14*d* of the stationary member 14. On the other hand, as the rear rotary element 32 is moved forward by the biasing force of the return spring 33 at the time of release of the writing lead L from the writing force, the through-holes 32*c* of the rear rotary element 32 are slid with respect to the engagement protrusions 14*d* of the stationary member 14*d*, whereby the forward movement of the rear rotary element 32 is converted into rotational movement of the rear rotary element 32 in a reverse rotational direction (a direction indicated by an arrow R in FIG. 15, i.e., a clockwise direction). Thus, the through-holes 32*c* of the rear rotary element 32 are sreturned to the states shown in FIG. 12. As the through-holes 32*c* are slid with respect to the engagement protrusions 14*d* in this way, the rotary element 32 is rotated in the reverse rotational direction R.

Figure 14:
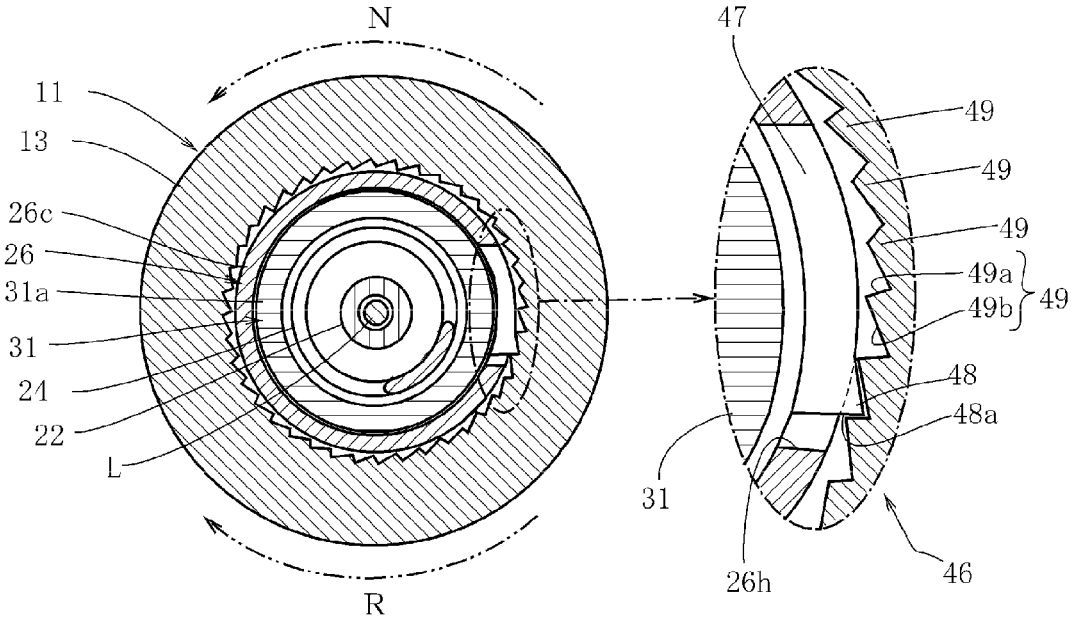
FIG. 14 is an E-E sectional view of FIG. 2.

The first tubular portion 32*a* of the rear rotary element 32 shown in FIGS. 8 and 9 is inserted in the front rotary element 31. The rear rotary element 32 has a first circumferentially extending elastic piece 42. The first elastic piece 42 is provided, at an end thereof in the extending direction of the first elastic piece 42, with a first ratchet pawl 43. As discussed above, the second tubular portion 31*b* of the front rotary element 31 has the plurality of first axially extending ratchet teeth 44 formed circumferentially around the inner peripheral surface thereof. The first ratchet pawl 43 of the rear rotary element 32 is configured to be capable of being selectively engaged with the plurality of first ratchet teeth 44. The first elastic piece 42 and the first ratchet teeth 44 serve as a normal directional rotation transmitting means 41 which, at the time of the normal directional rotation of the rear rotary element 32, transmits the normal direction rotation of the rear rotary element 32 to the front rotary element 31, to thereby cause the front rotary element 31 to be rotated in the normal rotational direction N (FIG. 14). They will be explained in detail hereinafter.

As shown in FIG. 8, the first tubular portion 32*a* of the rear rotary element 32 is formed with a side hole 32*d* which penetrates the first tubular portion 32*a* in a thickness direction of a wall of the first tubular portion 32*a*. The first elastic piece 42 briefly discussed above is formed integrally with the first tubular portion 32*a* of the rear rotary element 32 so as to circumferentially extend in the normal rotational direction from a side end edge of the side hole 32*d* which is opposite to the normal rotational direction. As discussed above, the first ratchet pawl 43 is provided at the end of the first elastic piece 42 in the extending direction of the first elastic piece 42. Incidentally, although the first elastic piece 42 is formed integrally with the rear rotary element 32 in this embodiment, the first elastic piece 42 and the rear rotary element 32 may be formed as separate components. In this case, the first elastic piece 42 is thereafter attached to the rear rotary element 32.

Figure 15:
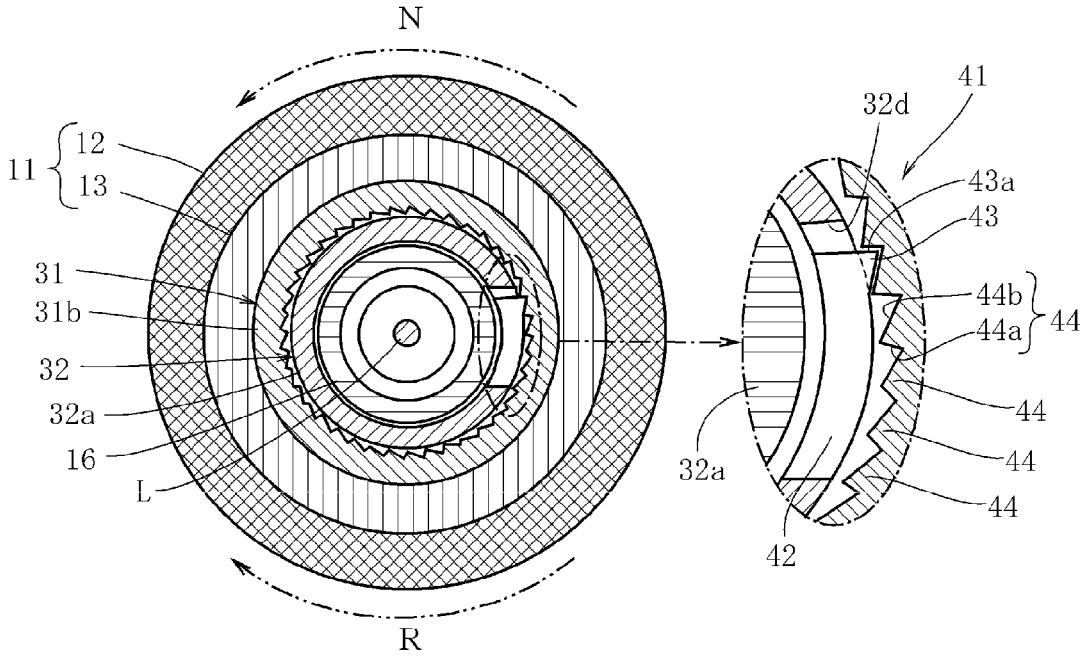
FIG. 15 is an F-F sectional view of FIG. 2.

Referring now to FIG. 15, the plurality of first axially extending ratchet teeth 44 are formed circumferentially around the inner peripheral surface of the second tubular portion 31*b* of the front rotary element 31 as described above. The first ratchet pawl 43 of the first elastic piece 42 of the rear rotary element 32 is always brought into a state where it enters between any two adjacent ratchet teeth 44 of the plurality of first ratchet teeth. The respective first ratchet teeth 44 include first engaging teeth surfaces 44*a*, with which an end surface 43*a* of the first ratchet pawl 43 of the rear rotary element 32 can be stoppingly engaged, and first gently sloping teeth surfaces 44*b* on which the first ratchet pawl 43 can be slid. The first engaging teeth surfaces 44*a* and the first gently sloping teeth surfaces 44*b* are alternately disposed in the circumferential direction around the inner peripheral surface of the second tubular portion 31*b* of the front rotary element 31. As shown in FIG. 15, the first ratchet teeth 44 are formed in such a manner that each of the first engaging teeth surfaces 44*a* is located forward of a corresponding first gently sloping tooth surface 44*b* in the normal rotational direction N.

In the state where the first ratchet pawl 43 enters between the two adjacent ratchet teeth 44 as shown in FIG. 15, when the rear rotary element 32 is rotated in the normal rotational direction N, the end surface 43*a* of the first ratchet pawl 43 of the rear rotary element 32 is engagedly abutted against a first engaging tooth surface 44*a* of one of the two adjacent ratchet teeth 44 of the front rotary element 31. Therefore, the first ratchet pawl 43 cannot get over the first engaging tooth surface 44*a* of the one of the two adjacent ratchet teeth 44. Thus, according to the normal directional rotation of the rear rotary element 32, the front rotary element 31 is push-moved by the first ratchet pawl 43 and rotated in the normal rotational direction. On the other hand, when the rear rotary element 32 is rotated in the reverse rotational direction R, the first ratchet pawl 43 is slid on a first gently sloping tooth surface 44*b* of the other of the two adjacent ratchet teeth 44 while allowing the first elastic piece 42 to be elastically deformed radially inward. Then, the first ratchet pawl 43 can get over a first engaging tooth surface 44*a* of the other of the two adjacent ratchet teeth 44 and operatively enter between the other of the two adjacent ratchet teeth 44 and a first ratchet tooth 44 arranged adjacently to the other of the two adjacent ratchet teeth 44 in the reverse rotational direction R. Incidentally, in this embodiment, forty first axially extending ratchet teeth 44 are formed around the inner peripheral surface of the second tubular portion 31*b* of the front rotary element 31, and the rear rotary element 32 is adapted to be rotated through approximately 9 degrees in the reverse rotational direction every time the first ratchet pawl 43 of the first elastic piece 42 of the rear rotary element 32 gets over a first engaging tooth surface 44*a* of any one of the first ratchet teeth 44. However, it goes without saying that the present invention is not limited to such a case.

As shown in FIGS. 2 and 3, the slider 26 is connected to the front rotary element 31 with the interior thereof receiving the first tubular portion 31*a* of the front rotary element 31, and is inserted in the tip member 13 so as to be relatively rotatable with respect to the tip member 13. As shown in FIGS. 6 and 7, the slider 26 is provided with a second elastic piece 47 extending in the circumferential direction thereof. The second elastic piece 47 has a second ratchet pawl 48 formed at an end thereof in the circumferentially extending direction of the second elastic piece 47. As shown in FIG. 5, the tip member 13 that is one of elements of the tubular shaft 11 in this embodiment has a plurality of second axially extending ratchet teeth 49 which are formed circumferentially around an inner peripheral surface of the tip member 13 and with which the second ratchet pawl 48 can be selectively engaged. The second elastic piece 47 and the second ratchet teeth 49 serve as a reverse directional rotation restricting means 46 for causing the combination of the slider 26 and front rotary element 31 to be maintained stable at the time of the reverse directional rotation of the rear rotary element 32. The second elastic piece 47 and the second ratchet teeth 49 will be described in detail hereinafter.

As shown in FIGS. 6 and 7, the slider 26 has a side hole 26*h* formed in the rear end portion 26*c* thereof and penetrating a wall of the rear end portion 26*c* in a thickness direction of the wall of the rear end portion 26*c*. The second elastic piece 47 is formed integrally with the rear end portion 26*c* of the slider 26 so as to extend circumferentially in the reverse rotational direction from a side end edge of the side hole 26*h*. As described above, the second ratchet pawl 48 is formed at the end of the second elastic piece 47 in the extending direction of the second elastic piece 47. Incidentally, although the second elastic piece 47 is formed integrally with the slider 26 in this embodiment, the slider 26 and the second elastic piece 47 may be formed as separate components. In this case, the second elastic piece 47 is thereafter attached to the slider 26.

As shown in FIG. 14, the plurality of second axially extending ratchet teeth 49 are formed circumferentially around the inner peripheral surface of the tip member 13. The second ratchet pawl 48 of the second elastic piece 47 of the slider 26 is always brought into a state where it enters between any two adjacent ratchet teeth 49 of the plurality of second axially extending ratchet teeth. The respective second ratchet teeth 49 include second engaging teeth surfaces 49*a*, with which an end surface 48*a* of the second ratchet pawl 48 can be stoppingly engaged, and second gently sloping teeth surfaces 49*b* on which the second ratchet pawl 48 can be slid. The second engaging teeth surfaces 49*a* and the second gently sloping teeth surfaces 49*b* are alternately formed around the inner peripheral surface of the tip member 13. Differently from the first ratchet teeth 44, the second ratchet teeth 49 are formed in such a manner that each of the second engaging teeth surfaces 49*a* is located rearward of a corresponding second gently sloping tooth surface 49*b* in the normal rotational direction N.

In the state where the second ratchet pawl 48 of the slider 26 enters between the two adjacent ratchet teeth 49 as shown in FIG. 14, when the slider 26, the front rotary element 31, and the rear rotary element 32 are moved rearward by the writing force, the rearward movement of the rear rotary element 32 is converted into the normal directional rotation by the conversion means 40. At this time, the normal directional rotation of the rear rotary element 32 is transmitted to the front rotary element 31, whereby the slider 26 and the front rotary element 31 are rotated in the normal rotational direction N. Then, the second ratchet pawl 48 can get over a second engaging tooth surface 49*a* of the one of the two adjacent ratchet teeth 49, and operatively enter between the one of the two adjacent ratchet teeth and a second ratchet tooth 49 arranged adjacently to the one of the two adjacent ratchet teeth 49 in the normal rotational direction N in FIG. 14. As in this way the second ratchet pawl 48 of the second elastic piece 47 can operatively enter between the one of the two adjacent ratchet teeth and the second ratchet tooth 49 arranged adjacently to the one of the two adjacent ratchet teeth 49 in the direction N, the slider 26 is idly rotated with respect to the tip member 13. When the rear rotary element 32 is rotated in the normal rotational direction, the slider 26 is idly rotated with respect to the tip member 13 in this way, so that the slider 26 and the front rotary element 31 can be rotated in the normal rotational direction. On the other hand, when the rear rotary element 32 is rotated in the reverse rotational direction by the action of the return spring 33, even if a force which tends to cause the front rotary element 31 and the slider 26 to be rotated in the reverse rotational direction (a direction indicated by an arrow R in FIG. 14, i.e., the clockwise direction) is exerted on the front rotary element 31 and the slider 26, the end surface 48*a* of the second ratchet pawl 48 of the slider 26 is stably abutted against a second engaging tooth surface 49*a* of the other of the two adjacent ratchet teeth 49 and cannot get over the second engaging tooth surface 49*a* of the other of the two adjacent ratchet teeth 49. Moreover, as discussed above, when the rear rotary element 32 is rotated in the reverse rotational direction R, the first ratchet pawl 43 of the rear rotary element 32 can be slid on the first gently sloping tooth surface 44*b* of the other of the two adjacent ratchet teeth while allowing the first elastic piece 42 of the rear rotary element 32 being elastically deformed radially inward. Then, the first ratchet pawl 43 can get over the first engaging tooth surface 44*a* of the other of the two adjacent ratchet teeth. Therefore, when the rear rotary element 32 is rotated in the reverse rotational direction, it is idly rotated with respect to the front rotary element 31, so that the front rotary element 31 and the slider 26 are not rotated in the reverse rotational direction and the rotational positions of them are maintained.

Incidentally, in this embodiment, forty second axially extending ratchet teeth 49 are formed circumferentially around the inner peripheral surface of the tip member 13, and the slider 26 is adapted to be rotated through approximately 9 degrees in the normal rotational direction every time the second ratchet pawl 48 of the second elastic piece 47 gets over a second engaging tooth surface 49*a* of any one of the second axially extending ratchet teeth 49. However, the present invention is not limited to such a case.

Next, the operation of the mechanical pencil 10 according to this embodiment will be explained.

When the knocking member 17 which partially projects rearward from the rear end of the tubular shaft 11 is subjected to knocking operation, the chuck unit 20 is moved forward to thereby move the writing lead L forward. As the writing lead L is moved forward by the chuck unit 20, a tip end of the writing lead L is projected out of the guide pipe 28 of the slider 26. In this state, when a writing force that is larger than the biasing force of the return spring 33 is applied to the projected tip end of the writing lead L, the front rotary element 31, the rear rotary element 32, the slider 26, and the chuck unit 20 holding the writing lead L are moved rearward in the tubular shaft 11. As the rear rotary element 32 is moved rearward in the tubular shaft 11, the through-holes 32*c* of the rear rotary element 32 are slid with respect to the engagement protrusions 14*d* of the stationary member 14, whereby the rear rotary element 32 is rotated with respect to the tubular shaft 11 in the normal rotational direction N (see FIG. 15).

When the rear rotary element 32 is rotated with respect to the tubular shaft 11 in the normal rotational direction in this way, the normal directional rotation of the rear rotary element 32 is transmitted the front rotary element 31 and the slider 26 to rotate the front rotary element 31 and the slider 26 in the normal rotational direction N (see FIG. 14). Namely, the front rotary element 31 is push-moved by the first ratchet pawl 43 of the rear rotary element 32 so as to be rotated in the normal rotational direction N, and the slider 26 connected to the front rotary element 31 is idly rotated with respect to the tip member 13 so as to be rotated in the normal rotational direction. At this time, the chuck ring 23 and the chuck spring 24 interposingly hold the flange portion 31*c* of the front rotary element 31, and the chuck unit 20 is also rotated in the normal rotational direction according to the normal directional rotation of the front rotary element 31, whereby the writing lead L held by the chuck member 22 is also rotated in the normal rotational direction.

On the other hand, when the projected tip end of the writing lead L is released from the writing force, the front rotary element 31, the rear rotary element 32, the slider 26, and the chuck unit 20 holding the writing lead L are moved forward in the tubular shaft 11 by the biasing force of the return spring 33. As the rear rotary element 32 is moved forward, the through-holes 32*c* of the rear rotary element 32 are slid with respect to the engagement protrusions 14*d* of the stationary member 14, whereby the rear rotary element 32 is rotated in the reverse rotational direction R (see FIG. 15).

Moreover, when the rear rotary element 32 is rotated in the reverse rotational direction with respect to the tubular shaft 11 in this way, the slider 26 and the front rotary element 31 are prevented from being rotated in the reverse rotational direction by the reverse directional rotation restricting means 46, and the rear rotary element 32 is idly rotated with respect to the front rotary element 31. Namely, although a force that tends to cause the front rotary element 31 and the slider 26 to be rotated in the reverse rotational direction R is exerted on the front rotary element 31 and the slider 26 according to the reverse directional rotation of the rear rotary element 32, the reverse directional rotation of the slider 26 and front rotary element 31 is prevented by the second ratchet pawl 48 of the slider 26 and the second ratchet tooth 49 of the tip member 13, rotational locations of them are maintained, and the rear rotary element 32 is idly rotated with respect to the front rotary element 31 so as to be rotated in the reverse rotational direction. Therefore, the slider 26 and the front rotary element 31 are not rotated in the reverse rotational direction with respect to the tubular shaft 11, the chuck unit 20 engaged with the front rotary element 31 and the writing lead L held by the chuck unit 20 are also not rotated in the reverse rotational direction, and the rotational positions of them are maintained.

When the rear rotary element 32 is moved rearward in the tubular shaft 11 by the writing force and the rearward movement of the rear rotary element 32 is then converted into the normal directional rotation of the rear rotary element 32 by the conversion means 40, the first ratchet pawl 43 of the first elastic piece 42 is operatively abutted against the first engaging tooth surface 44*a* of the first ratchet tooth 44 to push and rotate the rear rotary element 32 in the normal rotational direction and with a rotational amount that is commensurate to the variation of the writing force. Therefore, the writing lead can be rotated at a suitable rotational angle commensurate to the variation of the writing force. Incidentally, by increasing a length of the through-hole 32*c* of the conversion means 40, it is possible to increase the rotational amount of the writing lead L. Therefore, even if a relatively strong writing force is applied to the writing lead L, the writing lead can be rotated with a rotational amount that is commensurate to the relatively strong writing force.

(Second Embodiment)

Referring to FIGS. 16-23, a mechanical pencil according to a second embodiment of the present invention will be described hereinafter. The components and portions of the second embodiment that are similar to those of the first embodiment are denoted with like reference signs and the description of them is not repeated.

Although the slider 26 is adapted to be relatively rotatable with respect to the tubular shaft 11 (tip member 13) in the first embodiment, the slider 26 of the second embodiment is adapted to be unrotatable with respect to the tubular shaft 11 (tip member 13).

Figure 18:
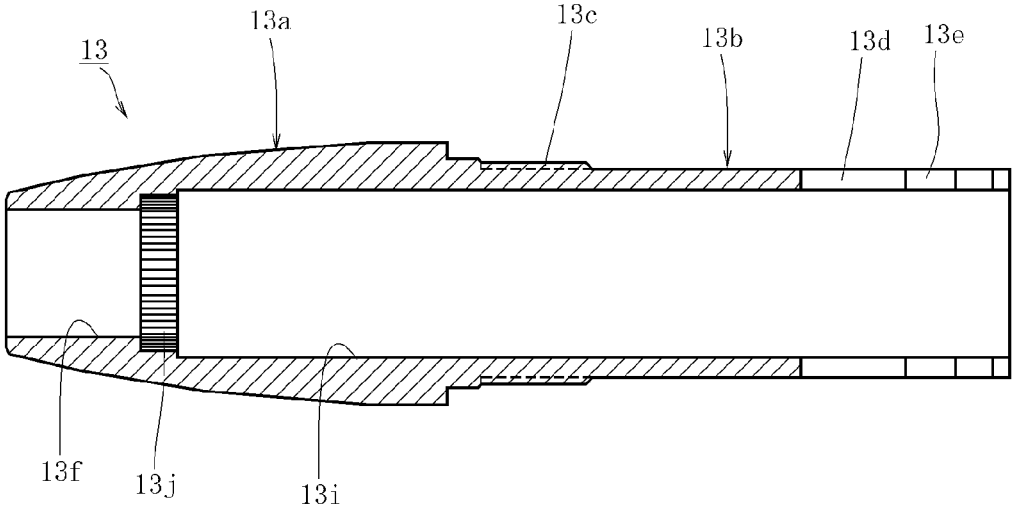
FIG. 18 is a G-G sectional view of FIG. 17.
Figure 19:
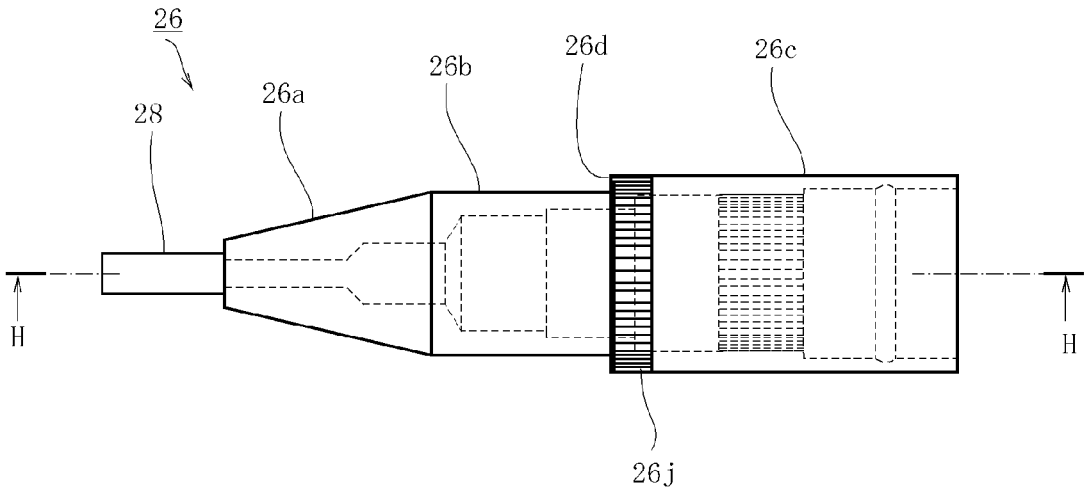
FIG. 19 is aside view showing a slider of the mechanical pencil according to the second embodiment.
Figure 20:
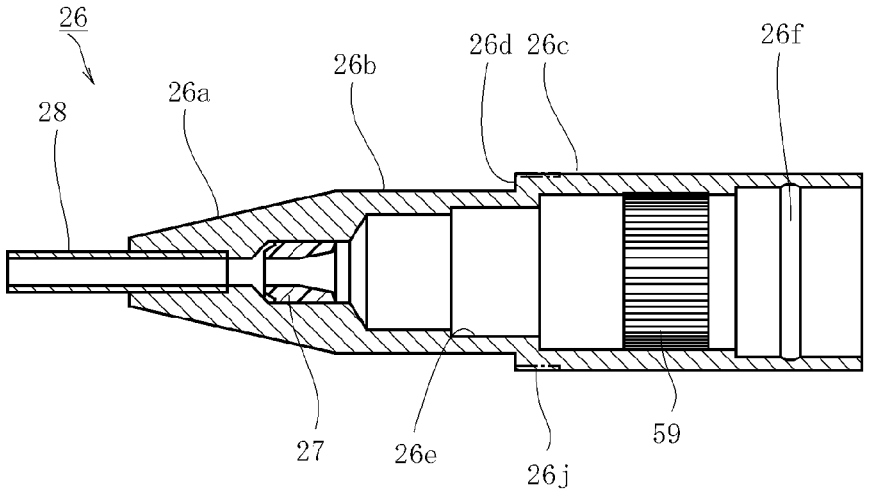
FIG. 20 is an H-H sectional view of FIG. 19.

More particularly, as shown in FIG. 18, the diameter of the inner peripheral surface of the tip member 13 is stepwise increased toward the rear end from the tip end of the tip member 13, and the tip member 13 has a small diameter bore 13*f* and a large diameter bore 13*i*. The small diameter bore 13*f* is configured so that it allows the tip end portion 26*a* and middle barrel portion 26*b* of the slider 26 to pass therethrough, but does not allow the rear end portion 26*c* of the slider 26 to pass therethrough. Moreover, the large diameter bore 13*i* is configured so that it allows the tip end portion 26*a*, middle barrel portion 26*b*, and rear end portion 26*c* of the slider 26 to pass therethrough. Moreover, a plurality of axially extending stripe-shaped protrusions 13*j* are disposed at predetermined intervals around an inner peripheral surface of a region between the small diameter bore 13*f* and the large diameter bore 13*i*. As shown in FIGS. 19 and 20, a plurality of axially extending recess grooves 26*j* are disposed at predetermined intervals around an outer peripheral surface of a tip end portion of the rear end portion 26*c* of the slider 26. The stripe-shaped protrusions 13*j* of the tip member 13 are engaged in the recess grooves 26*j* of the slider 26, whereby the slider 26 is adapted to be relatively unrotatable with respect to the tip member 13. Namely, the recess grooves 26*j* and the stripe-shaped protrusions 13*j* serve as a whirl-stopper means for the slider 26.

As discussed above, in the first embodiment, the engagement convex portion 31*d* of the front rotary element 31 is engaged in the engagement recess portion 26*f* of the slider 26, and the extension portions 31*e* of the front rotary element 31 are engaged in the notch portions 26*g* of the slider 26, whereby the front rotary element 31 and the slider 26 are connected to each other so as to be unrotatable relative to each other. On the other hand, the second embodiment is not provided with the notch portions 26*g* and the extension portions 31*e* which are shown in FIG. 7 and FIG. 8, respectively, and serve to prevent the front rotary element 31 and the slider 26 from rotating relative to each other. In the second embodiment, the engagement convex portion 31*d* of the front rotary element 31 shown in FIG. 21 and the engagement recess portion 26*f* of the slider 26 shown in FIG. 20 are engaged with each other, whereby the front rotary element 31 and the slider 26 are coupled to each other so as to be rotatable relative to each other in the circumferential direction.

Figure 16:
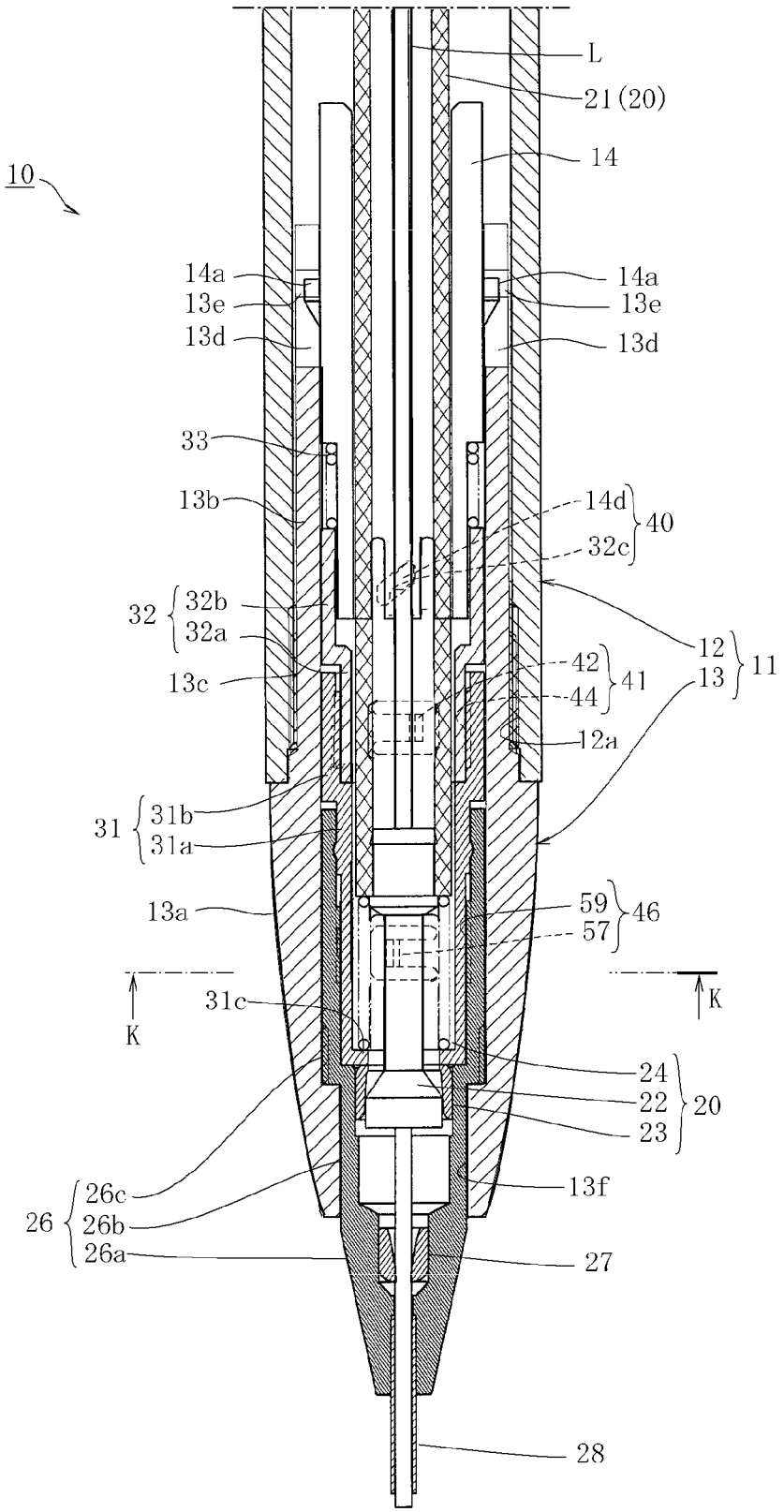
FIG. 16 is a vertically sectional enlarged view showing a tip end portion of a mechanical pencil according to a second embodiment of the present invention.
Figure 17:
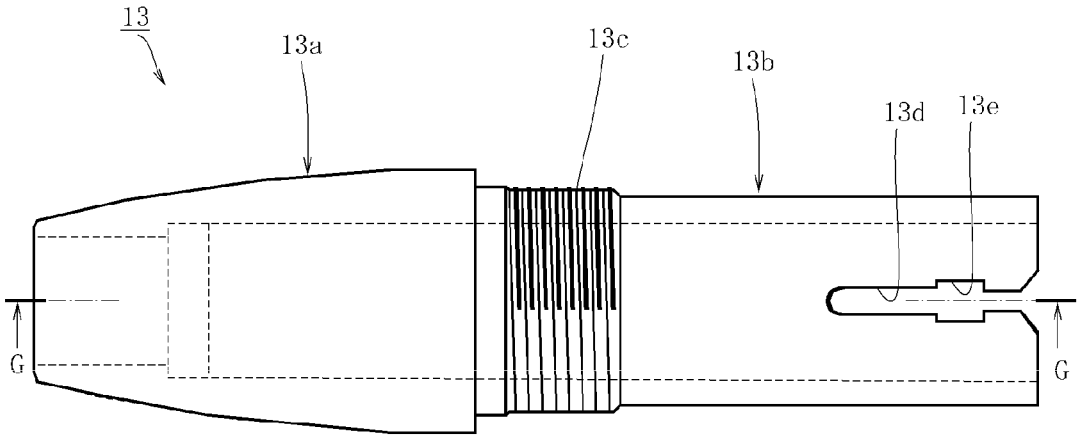
FIG. 17 is a side view showing a tip member of the mechanical pencil according to the second embodiment.

As discussed above, in the first embodiment, the second elastic piece 47 is provided at the slider 26 and the second axially extending ratchet teeth 49 are provided around the inner peripheral surface of the tubular shaft 11 (tip member 13). On the other hand, in the second embodiment, as shown in FIGS. 16, 20, and 21, a second elastic piece 57 is provided at the front rotary element 31, and a plurality of second axially extending ratchet teeth 59 are provided around the inner peripheral surface of the slider 26.

Figure 21:
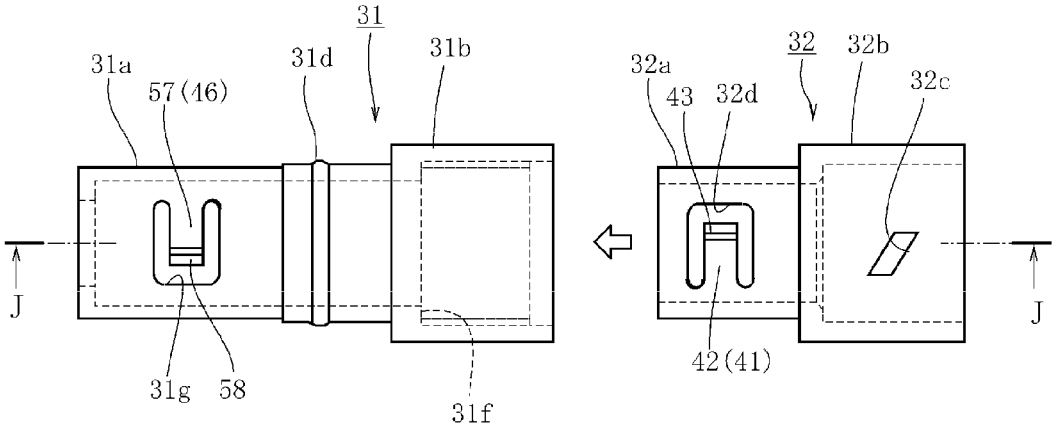
FIG. 21 is a side view showing front and rear rotary elements of the mechanical pencil according to the second embodiment.
Figure 22:
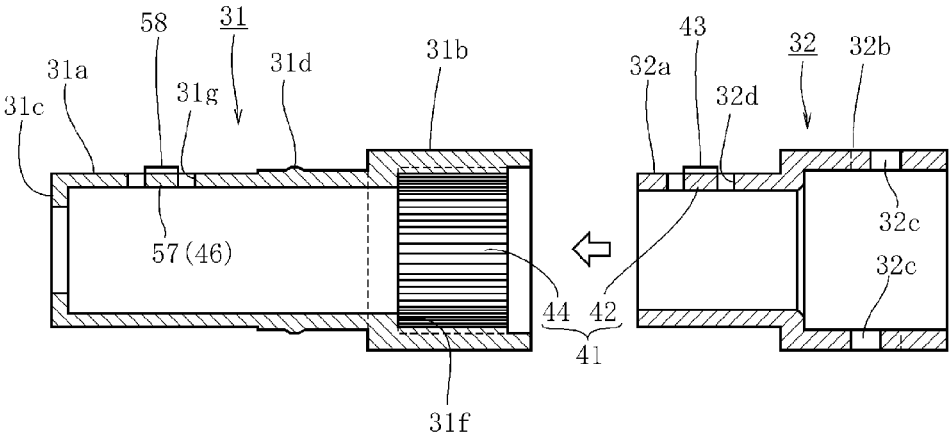
FIG. 22 is a J-J sectional view of FIG. 21.

More particularly, as shown in FIGS. 21 and 22, the first tubular portion 31*a* of the front rotary element 31 is formed with a side hole 31*g* that penetrates the wall of the first tubular portion 31*a* in a thickness direction of the wall of the first tubular portion 31*a*. The second elastic piece 57 is formed integrally with the first tubular portion 31*a* of the front rotary element 31 so as to circumferentially extend in the reverse rotational direction from a side edge of the side hole 31*g*. A second ratchet pawl 58 is provided at an end of the second elastic piece 57 in the extending direction of the second elastic piece 57. Incidentally, although the second elastic piece 57 is formed integrally with the front rotary element 31 in this embodiment, the front rotary element 31 and the second elastic piece 57 may be formed as separate components. In this case, the second elastic piece 57 is thereafter attached to the front rotary element 31.

Figure 23:
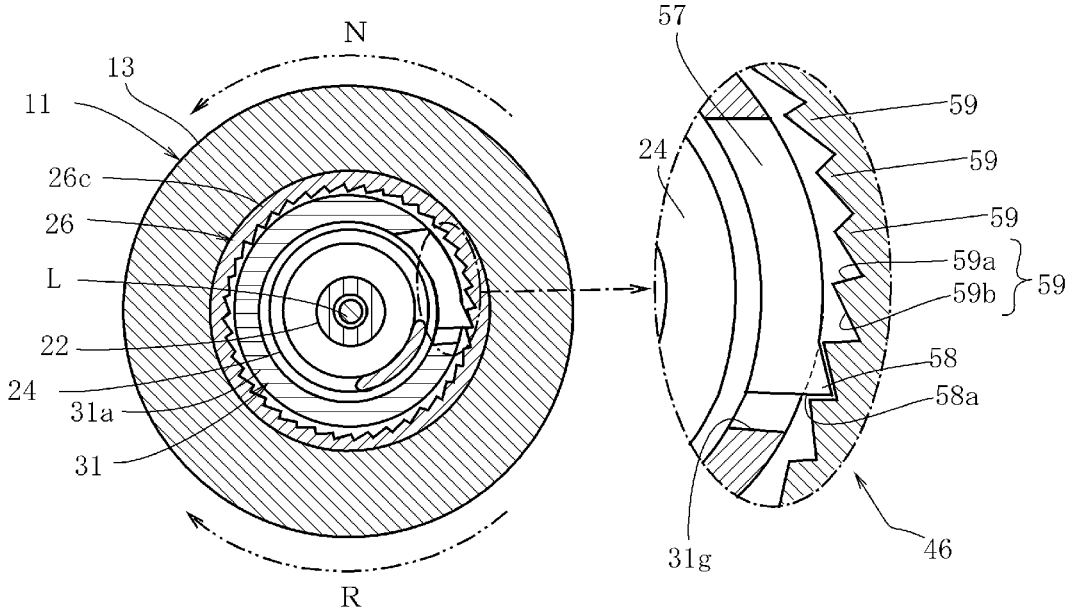
FIG. 23 is a K-K sectional view of FIG. 16.

As shown in FIG. 20, the plurality of second axially extending ratchet teeth 59 are disposed around the inner peripheral surface of the rear end portion 26*c* of the slider 26. The second ratchet pawl 58 of the second elastic piece 57 is always brought into a state where it enters between any two adjacent ratchet teeth 59 of the second axially extending ratchet teeth. As shown in FIG. 23, the respective second ratchet teeth 59 include second engaging teeth surfaces 59*a* with which an end surface 58*a* of the second ratchet pawl 58 can be stoppingly engaged, and second gently sloping teeth surfaces 59*b* on which the second ratchet teeth 59 can be slid. The second engaging teeth surfaces 59*a* and the second gently sloping teeth surfaces 59*b* are disposed alternately around the inner peripheral surface of the slider 26. Incidentally, the second ratchet teeth 59 are formed in such a manner that each of the second engaging teeth surfaces 59*a* is located rearward of a corresponding second gently sloping tooth surface 59*b* in the normal rotational direction N.

In a state where the second ratchet pawl 58 of the second elastic piece 57 of the front rotary element 31 enters between two adjacent ratchet teeth 59 as shown in FIG. 23, when the front rotary element 31 is rotated in the normal rotational direction N according to the normal directional rotation of the rear rotary element 32, the second ratchet pawl 58 is slid on a second gently sloping tooth surface 59*b* of one of the two adjacent ratchet teeth while allowing the second elastic piece 57 to be deformed radially inward. Then, the second ratchet pawl 58 can get over a second engaging surface 59*a* of the one of the two adjacent ratchet teeth 59 and operatively enter between the one of the two adjacent ratchet teeth 59 and a second ratchet tooth 59 arranged adjacently to the one of the two adjacent ratchet teeth 59 in the direction N. That is, when the front rotary element 31 is rotated in the normal rotational direction according to the normal directional rotation of the rear rotary element 32, the front rotary element 31 is idly rotated with respect to the slider 26. On the other hand, when the rear rotary element 32 is rotated in the reverse rotational direction in the tubular shaft 11, even if a force which tends to cause the front rotary element 31 to be rotated in the reverse rotational direction R is exerted on the front rotary element 31, the second ratchet pawl 58 cannot get over a second engaging tooth surface 59*a* of the other of the two adjacent ratchet teeth 59, since the end surface 58*a* of the second ratchet pawl 58 is abutted against the second engaging tooth surface 59*a* of the other of the two adjacent ratchet teeth 59. Moreover, like the first embodiment, when the rear rotary element 32 is rotated in the reverse rotational direction in the tubular shaft 11, the first ratchet pawl 43 is slid on the first gently sloping tooth surface 44*b* of the other of the two adjacent ratchet teeth 44 of the front rotary element 31 while allowing the first elastic piece 42 of the rear rotary element 32 to be deformed radially inward. Then, the first ratchet pawl 43 can get over the first engaging tooth surface 44*a* of the other of the two adjacent ratchet teeth 44. Therefore, when the rear rotary element 32 is rotated in the reverse rotational direction, the rear rotary element 32 is idly rotated with respect to the front rotary element 31, so that the front rotary element 31 is not rotated in the reverse rotational direction and the rotational position of the front rotary element 31 is maintained.

Incidentally, in the second embodiment, forty second axially extending ratchet teeth 59 are provided around the inner peripheral surface of the slider 26, and the front rotary element 31 is rotated through approximately 9 degrees in the normal rotational direction every time the second ratchet pawl 58 of the second elastic piece 57 gets over a second engaging tooth surface 59*a* of any one of the two adjacent ratchet teeth 59. However, it goes without saying that the present invention is not limited to such a case.

Next, the operation of the mechanical pencil according to the second embodiment will be explained.

When the knocking member 17 which partially projects rearward from the rear end of the tubular shaft 11 is subjected to knocking operation, the chuck unit 20 is moved forward to thereby move the writing lead L forward. As the writing lead L is moved forward by the chuck unit 20, a tip end of the writing lead L passes through the guide pipe 28 of the slider 26 and then operatively projected out of the guide pipe 28 of the slider 26. In this state, when a writing force that is larger than the biasing force of the return spring 33 is applied to the projected tip end of the writing lead L, the front rotary element 31, the rear rotary element 32, the slider 26 and the chuck unit 20 holding the writing lead L are moved rearward in the tubular shaft 11. As the rear rotary element 32 is moved rearward in the tubular shaft 11, the through-holes 32*c* of the rear rotary element 32 are slid with respect to the engagement protrusions 14*d* of the stationary member 14, whereby the rear rotary element 32 is rotated in the normal rotational direction with respect to the tubular shaft 11.

When the rear rotary element 32 is rotated in the normal rotational direction with respect to the tubular shaft 11 in this way, the normal directional rotation of the rear rotary element 32 is transmitted to the front rotary element 31 by the normal directional rotation transmitting means 41, to thereby rotate the front rotary element 31 in the normal rotational direction. Namely, the front rotary element 31 is push-moved by the first ratchet pawl 43 of the rear rotary element 32 and idly rotated with respect to the slider 26 so as to be rotated in the normal rotational direction N. At this time, the chuck ring 23 and the chuck spring 24 interposingly hold the flange portion 31*c* of the front rotary element 31 therebetween, and the chuck unit 20 is also rotated in the normal rotational direction according to the normal directional rotation of the front rotary element 31, whereby the writing lead held by the chuck unit 20 is also rotated in the normal rotational direction.

On the other hand, when the tip end of the writing lead L is released from the writing force, the front rotary element 31, the rear rotary element 32, the slider 26, and the chuck unit 20 holding the writing lead L are moved forward in the tubular shaft 11 by the biasing force of the return spring 33. As the rear rotary element 32 is moved forward, the through-holes 32*c* of the rear rotary element 32 are slid with respect to the engagement protrusions 14*d* of the stationary member 14, whereby the rear rotary element 32 is rotated in the reverse rotational direction.

Moreover, when the rear rotary element 32 is rotated in the reverse rotational direction with respect to the tubular shaft 11 in this way, the reverse directional rotation of the front rotary element 31 is prevented by the reverse directional rotation restricting means 46 and the rear rotary element 32 is idly rotated with respect to the front rotary element 31. Namely, although a force that tends to cause the front rotary element 31 to be rotated in the reverse rotational direction N acts on the front rotary element 31 according to the reverse directional rotation of the rear rotary element 32, the reverse directional rotation of the front rotary element 31 is prevented by cooperation of the second ratchet pawl 58 of the front rotary element 31 and the second ratchet tooth 59 of the slider 26, the rotational position of the front rotary element 31 is maintained, and the rear rotary element 32 is idly rotated with respect to the front rotary element 31 so as to be rotated in the reverse rotational direction. Therefore, the front rotary element 31 is not rotated in the reverse rotational direction with respect to the tubular shaft 11, and the chuck unit 20 engaged with the front rotary element 31 and the writing lead L held by the chuck unit 20 are also not rotated in the reverse rotational direction. Thus, the rotational positions of them are maintained.

When the rear rotary element 32 is moved rearward in the tubular shaft 11 by the writing force, the second ratchet pawl 58 of the second elastic piece 57 can get over an engaging tooth surface of at least one of the ratchet teeth 49 until the through-holes 32*c* of the rear rotary element 32 are slid to the utmost level with respect to the engagement protrusions 14*d* of the stationary member 14.

(Variants)

Except for the above-mentioned embodiments, the following variants may be employed.

For example, the engagement protrusion 14*d* of the conversion means 40 may be provided on the inner peripheral surface of the rear rotary element 32, and the through-holes 32*c* of the conversion means 40 may be formed in the stationary member 14.

Moreover, the engagement protrusions 14*d* of the conversion means 40 may be provided on the outer peripheral surface of the rear rotary element 32, and the through-holes 32*c* of the conversion means 40 may be formed in the tip member 13 (the tubular shaft 11).

Further, the rear end portion of the front rotary element 31 may be inserted in the rear rotary element 32, the first elastic piece of the normal directional rotation transmitting means 41 may be provided at the front rotary element 31, and the first ratchet teeth of the normal directional rotation transmitting means 41 may be provided on the inner peripheral surface of the rear rotary element 32.

Moreover, although the second ratchet teeth 49, 59 are formed so as to correspond in number to the first ratchet teeth 44 in the above-mentioned embodiments, the number of the second ratchet teeth 49, 59 may be increased relative to the number of the first ratchet teeth 44.

Further, as a variant of each of the above-mentioned embodiments, there may be employed a mechanical pencil that does not include the slider 26. In this case, the second elastic piece of the reverse directional rotation restricting means 46 may be provided at the front rotary element 31, and the second ratchet teeth of the reverse directional rotation restricting means 46 may be provided at the tip member 13 (the tubular shaft 11).

Moreover, although the tubular shaft 11 of each of the above-mentioned embodiments is assembled by causing the rear end portion of the tip member 13 to be inserted in the tubular shaft body 12, the tip end portion of the tubular shaft body 12 may be inserted in the tip member 13. In addition, although the tubular shaft body 12 and the tip member 13 are configured as separate components in each of the above-mentioned embodiments, they may be formed as one-piece member that comprises the tubular shaft body 12 and the tip member 13.

Incidentally, referring to FIGS. 14, 15, and 23, the normal rotational direction N has been referred to as the counterclockwise direction and the reverse rotational direction R has been referred to as the clockwise direction in the above-mentioned embodiments. However, it goes without saying that the normal rotational direction and the reverse rotational direction may be set so as to become the clockwise direction and the counterclockwise direction, respectively.

INDUSTRIAL APPLICABILITY

The mechanical pencil according to the present invention is the mechanical pencil which allows the writing lead to be rotated at a suitable rotational angle commensurate to the variation of the writing force. With this mechanical pencil, it is possible to prevent the occurrence of a phenomenon in which, if writing by the mechanical pencil is continued in a state where the tubular shaft of the mechanical pencil is inclined with respect to a surface of a sheet of paper, a tip end of the writing lead will be unsymmetrically worn and, consequently, lines that are drawn on the surface of the sheet of paper after an area of the unsymmetrically worn surface of the writing lead is increased become thick as compared to lines which were drawn on the surface of the sheet of paper when the writing is commenced. In addition, with the mechanical pencil, it is possible to prevent the occurrence of a phenomenon in which the increase in the area of the unsymmetrically worn surface of the writing lead will cause blurred areas to be produced in the drawn lines.

REFERENCE SIGNS LIST

10: Mechanical pencil
11: Tubular shaft
12: Tubular shaft body
12*a*: Internal thread
13: Tip member
13*a*: Tapered portion
13*b*: Insertion tubular portion
13*c*: External thread
13*d*: Slit
13*e*: Increased width portion
13*f*: Small diameter bore
13*g*: Middle diameter bore
13*h*: Step portion
13*j*: Stripe-shaped protrusion
14: Stationary member
14*a*: Engagement protrusion
14*b*: Small diameter portion
14*c*: Large diameter portion
14*d*: Engagement protrusion
14*e*: Slit
14*f*: Swing piece
17: Knocking member
17*a*: Receiver base
17*b*: Eraser
17*c*: Cover
20: Chuck unit
21: Writing lead storage case
22: Chuck member
23: Chuck ring
24: Chuck spring
26: Slider
26*a*: Tip end portion
26*b*: Middle barrel portion
26*c*: Rear end portion
26*d*: Step portion
26*e*: Receiving portion
26*f*: Engagement recess portion
26*g*: Notch portion
26*h*: Side hole
26*j*: Recess groove
27: Writing lead return stopper member
28: Guide pipe
31: Front rotary element
31*a*: First tubular portion of front rotary element
31*b*: Second tubular portion of front rotary element
31*c*: Flange portion
31*d*: Engagement convex portion
31*e*: Extension portion
31*f*: Step portion
31*g*: Side hole
32: Rear rotary element
32*a*: First tubular portion of rear rotary element
32*b*: Second tubular portion of rear rotary element
32*c*: Through-hole
32*d*: Side hole
32*e*: Step portion
33: Return spring
40: Conversion means
41: Normal directional rotation transmitting means
42: First elastic piece
43: First ratchet pawl
43*a*: End surface
44: First ratchet tooth
44*a*: First engaging tooth surface
44*b*: First gently sloping tooth surface
46: Reverse directional rotation restricting means
47: Second elastic piece
48: Second ratchet pawl
48*a*: End surface
49: Second ratchet tooth
49*a*: Second engaging tooth surface
49*b*: Second gently sloping tooth surface
57: Second elastic piece
58: Second ratchet pawl
58*a*: End surface
59: Second ratchet tooth
59*a*: Second engaging tooth surface
59*b*: Second gently sloping tooth surface
L: Writing lead

What is claimed is:

1. A mechanical pencil comprising:
a tubular shaft;
a chuck unit for releasably holding a writing lead;
the chuck unit being movably arranged in the tubular shaft;
a front rotary element provided in the tubular shaft;
a rear rotary element provided in the tubular shaft so as to be disposed rearward of the front rotary element;
the chuck unit being movably arranged in the tubular shaft so as to be inserted through the rear rotary element and the front rotary element;
the front rotary element being adapted to be moved rearward according to rearward movement of the chuck unit;
the rear rotary element being adapted to be moved rearward according to rearward movement of the front rotary element;
a conversion means for causing the rear rotary element to be rotated in a normal rotational direction as the rear rotary element is moved rearward and for causing the rear rotary element to be rotated in a reverse rotational direction opposite the normal rotational direction as the rear rotary element is moved forward;
a normal directional rotation transmitting means for allowing the front rotary element to be rotated in the normal rotational direction as the rear rotary element is rotated in the normal rotational direction and for causing the rear rotary element to be idly rotated with respect to the front rotary element at a time of reverse directional rotation of the rear rotary element; and
a reverse directional rotation restricting means for allowing normal directional rotation of the front rotary element but preventing reverse directional rotation of the front rotary element.

2. The mechanical pencil according to claim 1, wherein the mechanical pencil further includes a stationary member inserted in a rear end portion of the rear rotary element and fixed with respect to the tubular shaft, and the conversion means comprises engagement protrusions projecting from one of the stationary member and the rear rotary element toward the other of the stationary member and the rear rotary element, and through-holes or inner peripheral grooves formed in the other of the stationary member and the rear rotary element so as to circumferentially obliquely extend, the through-holes or inner peripheral grooves being engaged with the engagement protrusions.

3. The mechanical pencil according to claim 1, wherein the conversion means comprises engagement protrusions projecting from one of the rear rotary element and the tubular shaft toward the other of the rear rotary element and the tubular shaft, and through-holes or inner peripheral grooves formed in the other of the rear rotary element and the tubular shaft so as to circumferentially obliquely extend, the through-holes or inner peripheral grooves being engaged with the engagement protrusions.

4. The mechanical pencil according to claim 1, wherein the rear rotary element is inserted in the front rotary element, and the normal directional rotation transmitting means comprises a first elastic piece provided at the rear rotary element so as to extend in a circumferential direction of the rear rotary element and having a first ratchet pawl provided at an end of the first elastic piece in a circumferentially extending direction of the first elastic piece, and a plurality of first axially extending ratchet teeth disposed around an inner peripheral surface of the front rotary element, the first ratchet pawl being adapted to be selectively engageable with the plurality of first axially extending ratchet teeth.

5. The mechanical pencil according to claim 1, wherein the front rotary element is inserted in the rear rotary element, and the normal directional rotation transmitting means comprises a first elastic piece provided at the front rotary element so as to extend in a circumferential direction of the front rotary element and having a first ratchet pawl provided at an end of the first elastic piece in a circumferentially extending direction of the front rotary element, and a plurality of first axially extending ratchet teeth disposed around an inner peripheral surface of the rear rotary element, the first ratchet pawl being adapted to be selectively engageable with the plurality of first axially extending ratchet teeth.

6. The mechanical pencil according to claim 1, wherein the mechanical pencil further includes a slider allowing the writing lead to pass therethrough and inserted in a tip end portion of the tubular shaft so as to be relatively rotatable with respect to the tubular shaft, and inserted in the front rotary element so as to be relatively unrotatable with respect to the front rotary element, and the reverse directional rotation restricting means comprises a second elastic piece provided at the slider so as to extend in a circumferential direction of the slider and having a second ratchet pawl provided at an end of the second elastic piece in the circumferential direction of the second elastic piece, and a plurality of second axially extending ratchet teeth provided around an inner peripheral surface of the tubular shaft, the second ratchet pawl being adapted to be selectively engageable with the plurality of second axially extending ratchet teeth.

7. The mechanical pencil according to claim 1, wherein the mechanical pencil further includes a slider allowing the writing lead to pass therethrough, the slider being inserted in a tip end portion of the tubular shaft so as to be relatively unrotatable with respect to the tubular shaft, and inserted in the front rotary element so as to be relatively rotatable with respect to the front rotary element, and the reverse directional rotation restricting means comprises a second elastic piece provided at the front rotary element so as to extend in a circumferential direction of the front rotary element and having a second ratchet pawl provided at an end of the second elastic piece in a circumferentially extending direction of the second elastic piece, and a plurality of second axially extending ratchet teeth provided around an inner peripheral surface of the slider, the second ratchet pawl being adapted to be selectively engageable with the plurality of second ratchet teeth.

8. The mechanical pencil according to claim 1, wherein the reverse directional rotation restricting means comprises a second elastic piece provided at the front rotary element so as to extend in a circumferential direction of the front rotary element and having a second ratchet pawl provided at an end of the second elastic piece in a circumferentially extending direction of the second elastic piece, and a plurality of second axially extending ratchet teeth disposed around an inner peripheral surface of the tubular shaft, the second ratchet pawl being adapted to be selectively engageable with the plurality of second axially extending ratchet teeth.

* * * * *